US010946297B2

(12) United States Patent
Wallace

(10) Patent No.: US 10,946,297 B2
(45) Date of Patent: Mar. 16, 2021

(54) COMBINED TOY DOLL AND ARTIFICIAL FLOWER

(76) Inventor: Albert D. Wallace, Decatur, AL (US)

( * ) Notice: Subject to any disclaimer, the term of this patent is extended or adjusted under 35 U.S.C. 154(b) by 0 days.

(21) Appl. No.: 12/834,670

(22) Filed: Jul. 12, 2010

(65) Prior Publication Data

US 2012/0003899 A1 Jan. 5, 2012

Related U.S. Application Data

(60) Provisional application No. 61/270,605, filed on Jul. 10, 2009.

(51) Int. Cl.
*A63H 3/00* (2006.01)
*A63H 33/00* (2006.01)
*A63H 3/12* (2006.01)

(52) U.S. Cl.
CPC ..... *A63H 33/003* (2013.01); *A63H 3/00* (2013.01); *A63H 3/12* (2013.01)

(58) Field of Classification Search
CPC ..... A63H 3/16; A63H 3/003; A63H 3/005; A63H 33/00; A63H 33/16; A63H 3/00; A63H 3/12; A63H 33/003
USPC ..... 446/268, 71–74, 76
See application file for complete search history.

(56) References Cited

U.S. PATENT DOCUMENTS 226,922 A * 4/1880 Moses ..... B65D 51/246 220/212
821,468 A 5/1906 Dashiell
1,396,766 A * 11/1921 McClelland ..... A63H 3/12 446/321
1,615,925 A * 2/1927 Yancey ..... A63H 3/12 446/310
3,471,964 A * 10/1969 Cherry ..... A63H 33/00 446/268
3,597,877 A 8/1971 Speers
3,864,871 A * 2/1975 Kaelin ..... A63H 3/14 446/327
4,107,873 A * 8/1978 Bauer ..... A63H 3/02 446/321
4,336,665 A * 6/1982 Moreau ..... A63H 33/004 446/321

(Continued)

FOREIGN PATENT DOCUMENTS

GB 2131310 A * 6/1984 ..... A63H 33/00

OTHER PUBLICATIONS

Carmen Agra Deedy, The Library Dragon Flip Doll, http://peachtree-online.com/product/2782.aspx, Jan. 29, 2010.

(Continued)

*Primary Examiner* — Eugene L Kim
*Assistant Examiner* — Alyssa M Hylinski
(74) *Attorney, Agent, or Firm* — Albert D. Wallace

(57) ABSTRACT

The present disclosure generally pertains to toys that have dolls combined with artificial flowers. A topsy turvy toy in one exemplary embodiment comprises an artificial flower at one end and a doll having a head at an opposite end. A cover is coupled to the toy between the head and the artificial flower. In one mode of use, the cover is pulled over the doll substantially hiding the doll and exposing the artificial flower. For another mode of use, the cover is pulled over the artificial flower substantially hiding the artificial flower and exposing the doll. Accordingly, the toy is selectively transformed from a doll to an artificial flower and vice versa.

18 Claims, 26 Drawing Sheets

(56) References Cited

U.S. PATENT DOCUMENTS 4,639,233 A * 1/1987 Brassfield ..... A63H 3/12
446/321
4,795,398 A * 1/1989 Wexler ..... A63H 3/003
428/24
5,149,289 A * 9/1992 Edwards ..... A63H 3/12
446/268
5,194,030 A * 3/1993 LeBoeuf ..... A63H 3/003
434/433
5,224,894 A * 7/1993 Nelson ..... A63H 33/004
428/17
5,522,758 A * 6/1996 Liu ..... A63H 13/00
40/411
5,676,584 A * 10/1997 Perryman ..... A63H 3/02
446/321
5,882,104 A * 3/1999 Oliver ..... A63H 37/00
362/161
6,126,507 A * 10/2000 Lieberman ..... A42B 1/004
2/209.11
D541,891 S 5/2007 Warren

OTHER PUBLICATIONS

CookiePots.com, Topsy Turvy Dolls, http://www.cookiepots.com/Topsy%20Turvy%20Doll.htm, Jan. 29, 2010.
Seventh Avenue, KinderGarden Babies, http://www.seventhavenue.com/Gifts-and-Collectibles/Toys/Kindergarden-Babies.pro?fp . . . ,Oct. 25, 2010.
Complaint/Petition, Case No. CV-10-1769KKH, filed in the Circuit Court of Madison County, Alabama on Dec. 29, 2010.
Hawaii Protea Flower Doll Handmade, Maui "Miss Pua,"Ebay, http://www.ebay.com/ltm/Hawaii-PROTEA-FLOWER-DOLL-Handmade-Maui-Miss-Pua-/172612405147?hash=item283080479b:g:qQYAAOSwmgJY5Tq4, Sep. 27, 2017.

* cited by examiner

COMBINED TOY DOLL AND ARTIFICIAL FLOWER

RELATED APPLICATION

This application claims priority to U.S. Provisional Patent Application No. 61/270,605, entitled "Combined Toy Doll and Artificial Flower" and filed on Jul. 10, 2009, which is incorporated herein by reference.

RELATED ART

Various types of toys have been developed that combine toy dolls and flowers. For example, U.S. Pat. No. 5,522,758 discloses a toy that has a doll embedded within the petals of a toy flower. The petals hide the doll but can be opened in order to reveal the doll. Unfortunately, the size of the petals is often a limiting factor for the size of the doll, and the shape of the petals must be designed to accommodate doll. For such toys, a less than ideal design of the doll and/or flower may be used to enable the doll to be embedded within the petals of the toy flower.

In addition, U.S. Pat. No. 4,795,398 discloses a puppet that can be pulled from a simulated flower pot. The back of the puppet's head is shaped as a flower, which is exposed when the puppet is in the simulated flower pot. However, once the puppet is pulled from the simulated flower pot, the flower is still visible distracting from the visual appearance of the puppet.

As illustrated by the foregoing examples, designing toys that combine toy figures and flowers can be a problematic process that involves trade-offs between operability and aesthetic qualities.

BRIEF DESCRIPTION OF THE DRAWINGS

The disclosure can be better understood with reference to the following drawings. Like reference numerals designate corresponding parts throughout the several views.

DETAILED DESCRIPTION

The present disclosure generally pertains to toys that have dolls combined with artificial flowers. A topsy turvy toy in one exemplary embodiment comprises an artificial flower at one end and a doll having a head at an opposite end. A cover is coupled to the toy between the head and the artificial flower. In one mode of use, the cover is pulled over the doll substantially hiding the doll and exposing the artificial flower. For another mode of use, the cover is pulled over the artificial flower substantially hiding the artificial flower and exposing the doll. Accordingly, the toy is selectively transformed from a doll to an artificial flower and vice versa.

Figure 1:
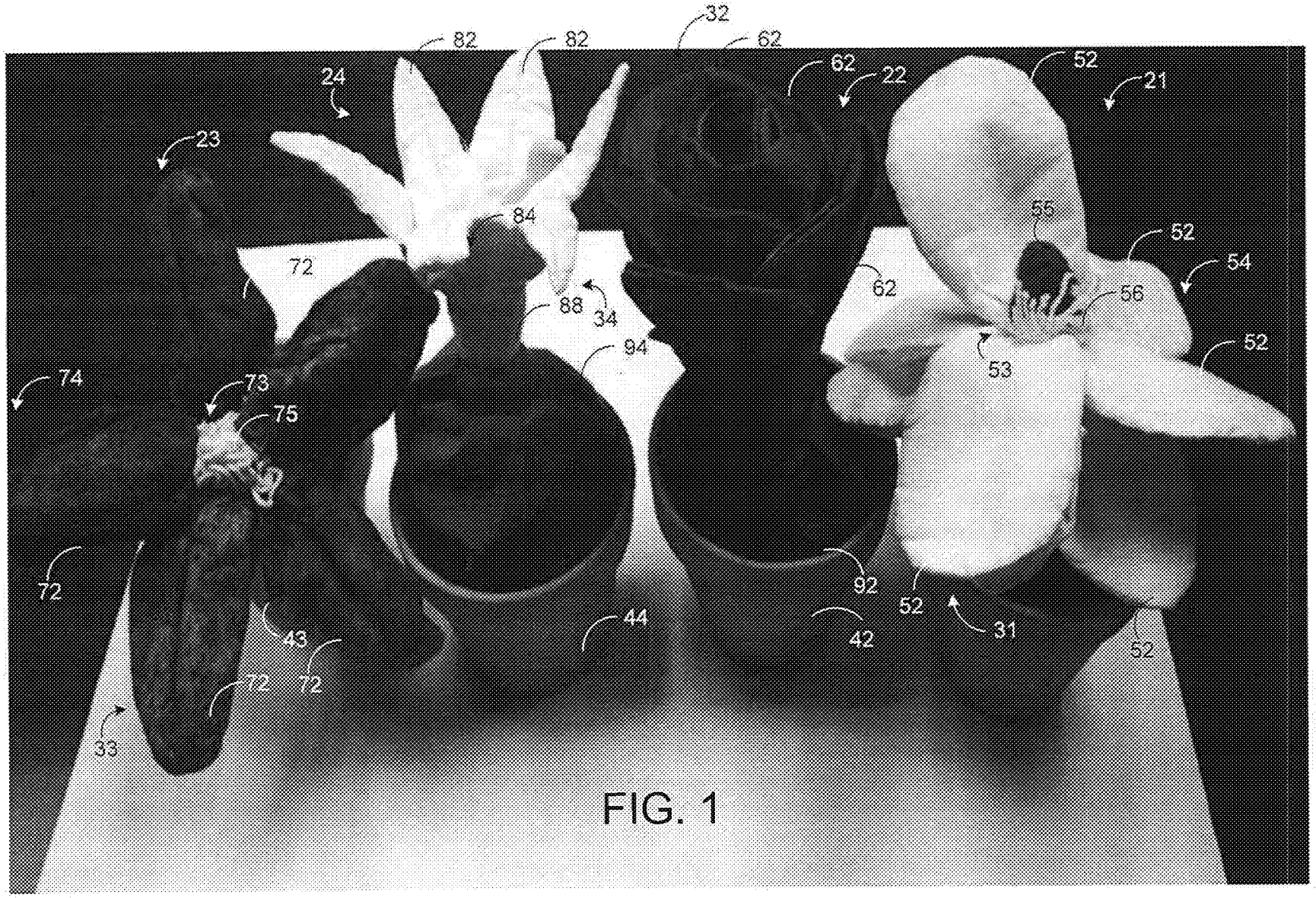
FIG. 1 depicts exemplary embodiments of toys that have dolls combined with artificial flowers.

FIG. 1 depicts various embodiments of topsy turvy toys 21-24 having combined dolls and artificial flowers. One end of the toy 21 forms an artificial flower 31 that represents a magnolia blossom. One end of the toy 22 forms an artificial flower 32 that represents a rose. Further, one end of the toy 23 forms an artificial flower 33 that represents an African violet, and one end of the toy 24 forms an artificial flower 34 that resembles a lily. In other embodiments, other types of toys representing other types of flowers or plants are possible.

In FIG. 1, the toys 21-24 are positioned in flower pots 41-44, respectively. Thus, each of the artificial flowers 31-34 appears to be potted making these artificial flowers 31-34 appear more realistic. Each of the flower pots 41-44 is composed of clay similar to some conventional flower pots for holding live flowers. However, other types of flower pots 41-44 may be used in other embodiments. For example, the flower pots 41-44 may be composed of plastic similar to conventional toy buckets. In another exemplary embodiment, the flower pots 41 may be ceramic similar to some conventional flower pots for holding live flowers. In yet other embodiments, flower pots 41-44 are not used to hold the toys 21-24.

The exemplary artificial flower 31 depicted in FIG. 1 has a plurality of petals 52 that resemble the petals of a magnolia blossom. Each petal 52 has an outer covering composed of cotton and a light weight polyester interface that is embedded in the outer covering. The embedded interface provides mechanical support that helps the petal 52 to hold its shape.

In other embodiments, other types of materials may be used for the outer covering and/or the embedded interface.

Each petal 52 is elongated with a proximal end 53 of the petal 52 sewed or otherwise coupled to at least one other component of the toy 21. In one exemplary embodiment, the proximal end 53 of at least one petal 52 is sewn directly to a body (not shown in FIG. 1) of the toy 21, as will be described in more detail hereafter, and one or more petals 52 are sewn to the body and/or other petals 52. In this regard, the proximal end 53 of each petal 52 is sewn directly to the body (not shown in FIG. 1), a proximal end 53 of at least one other petal 52, or both the body and a proximal end 53 of at least one other petal 52. However, in other embodiments, other configurations of the artificial flower 31 and other techniques for sewing or otherwise coupling the petals 52 to components of the toy 21 are possible. In addition, techniques other than sewing may be used to couple any of the petals 52 to components of the toy 21.

As described above, a proximal end 53 of each petal 52 is coupled via sewing or otherwise to at least one other component of the toy 21. However, the remainder of the petal 52, including a distal end 54 that is opposite of the proximal end 53, is free to move relative to the other components of the toy 21.

As shown by FIG. 1, an artificial flower element 55 and strands 56 of yarn are coupled to at least one petal 52. In one exemplary embodiment, the flower element 55 comprises an outer covering composed of cotton and a light weight polyester interface that is embedded in the outer covering, and the element 55 and strands 56 are sewn to the proximal end 53 of at least one petal 52 that is sewn or otherwise coupled to the toy 21. However, other materials for the element 55 and strands 56 and other techniques for coupling the element 55 and strands 56 to the petal 52 are possible in other embodiments. The element 55 and strands 56 represent the stamens and pistils of the artificial flower 31. In other embodiments, other types of components may be used to represent the stamens and pistils.

The exemplary artificial flower 32 depicted in FIG. 1 has a plurality of petals 62 that resemble the petals of a rose. Each petal 62 has an outer covering composed of cotton and a light weight polyester interface that is embedded in the outer covering. The embedded interface provides mechanical support that helps the petal 62 to hold its shape. In other embodiments, other types of materials may be used for the outer covering and/or the embedded interface.

Each petal 62 has a proximal end 63 that is sewn or otherwise coupled to at least one other component of the toy 22 and a distal end 64 that is opposite of the proximal end 63. In particular, the proximal end 63 of at least one petal 62 is sewn directly to a body (not shown in FIG. 1) of the toy 22, as will be described in more detail hereafter, and one or more petals 62 are sewn to the body and/or other petals 62. In this regard, the proximal end 63 of each petal 62 is sewn directly to the body (not shown in FIG. 1), another petal 62, or both the body and another petal 62. However, in other embodiments, other configurations of the artificial flower 32 and other techniques for sewing or otherwise coupling the petals 62 to other components of the toy 22 are possible, and techniques other than sewing may be used to couple any of the petals 62 to other components of the toy 22.

As described above, a proximal end 63 of each petal 62 is coupled via sewing or otherwise to at least one other component of the toy 22. However, the remainder of the petal 62, including its distal end 64, is free to move relative to the other components of the toy 22.

The exemplary artificial flower 33 depicted in FIG. 1 has a plurality of petals 72 that resemble the petals of an African violet. Each petal 72 has an outer covering composed of cotton and a light weight polyester interface that is embedded in the outer covering. The embedded interface provides mechanical support that helps the petal 82 to hold its shape. In other embodiments, other types of materials may be used for the outer covering and/or the embedded interface. In one exemplary embodiment, each of the embedded interfaces of the petals 72 is bunched to provide a thicker petal 72 relative to the petals 52, 62, and 82 of the other artificial flowers 31, 32, and 34. Moreover, the embedded interface of the petals 42, 62, and 82 are substantially flat.

Each petal 72 is elongated with a proximal end 73 sewed or otherwise coupled to the toy 23. In one exemplary embodiment, the proximal end 73 of each petal 72 is sewn directly to a body (not shown in FIG. 1) of the toy 23, as will be described in more detail hereafter. If desired, the proximal end 73 of any petal 72 may also be sewn to at least one adjacent petal 72. However, in other embodiments, other configurations of the artificial flower 33 and other techniques for sewing or otherwise coupling the petals 72 to components of the toy 23 are possible. In addition, techniques other than sewing may be used to couple any of the petals 72 to components of the toy 23.

As described above, a proximal end 73 of each petal 72 is coupled via sewing or otherwise to at least one other component of the toy 23. However, the remainder of the petal 72, including a distal end 74 that is opposite of the proximal end 73, is free to move relative to the other components of the toy 23 and the other petals 72.

As shown by FIG. 1, a ball 75 of yarn is coupled to at least one petal 72 and/or the body (not shown in FIG. 1) of the toy 23, although it is possible for the ball 75 to be composed of other materials in other embodiments. In one exemplary embodiment, the ball 75 is sewn to each of the petals 72, but other techniques for coupling the ball 75 to the petals 72 are possible in other embodiments. The ball 75 represents the stamens and pistils of the artificial flower 33. In other embodiments, other types of components may be used to represent the stamens and pistils.

The exemplary artificial flower 34 depicted in FIG. 1 has a plurality of petals 82 that resemble the petals of a lily. Each petal 82 has an outer covering composed of cotton and a light weight polyester interface that is embedded in the outer covering. The embedded interface provides mechanical support that helps the petal 82 to hold its shape. In other embodiments, other types of materials may be used for the outer covering and/or the embedded interface.

Each petal 82 is elongated with a proximal end 83 sewn or otherwise coupled to at least one other component of the toy 24. In one exemplary embodiment, the proximal end 83 of each petal 82 is sewn to the toy 24, and a distal end 84, which is opposite of the proximal end 83, is pointed. The proximal end 83 of each petal 52 is sewn directly to a body (not shown in FIG. 1) of the toy 24, as will be described in more detail hereafter. In addition, a portion of each side of each petal 82 is sewn or otherwise coupled to a side of an adjacent petal 82. Thus, the petals 82 form a cylindrical, hollow base 88 having one end that is coupled directly to the body of the toy 24. The base 88 supports the distal ends 84 of the petals 82 such that these ends 84 hang from the base 88, as shown by FIG. 1. However, in other embodiments, other configurations of the artificial flower 34 and other techniques for sewing or otherwise coupling the petals 82 to components of the toy 24 are possible. In addition, techniques other than sewing may be used to couple any of the petals 82 to components of the toy 24.

As described above, a proximal end 83 of each petal 82 is coupled via sewing or otherwise to at least one other component of the toy 24. However, the distal end 84 of the petal 82 is free to move relative to the other components of the toy 24.

Figure 2:
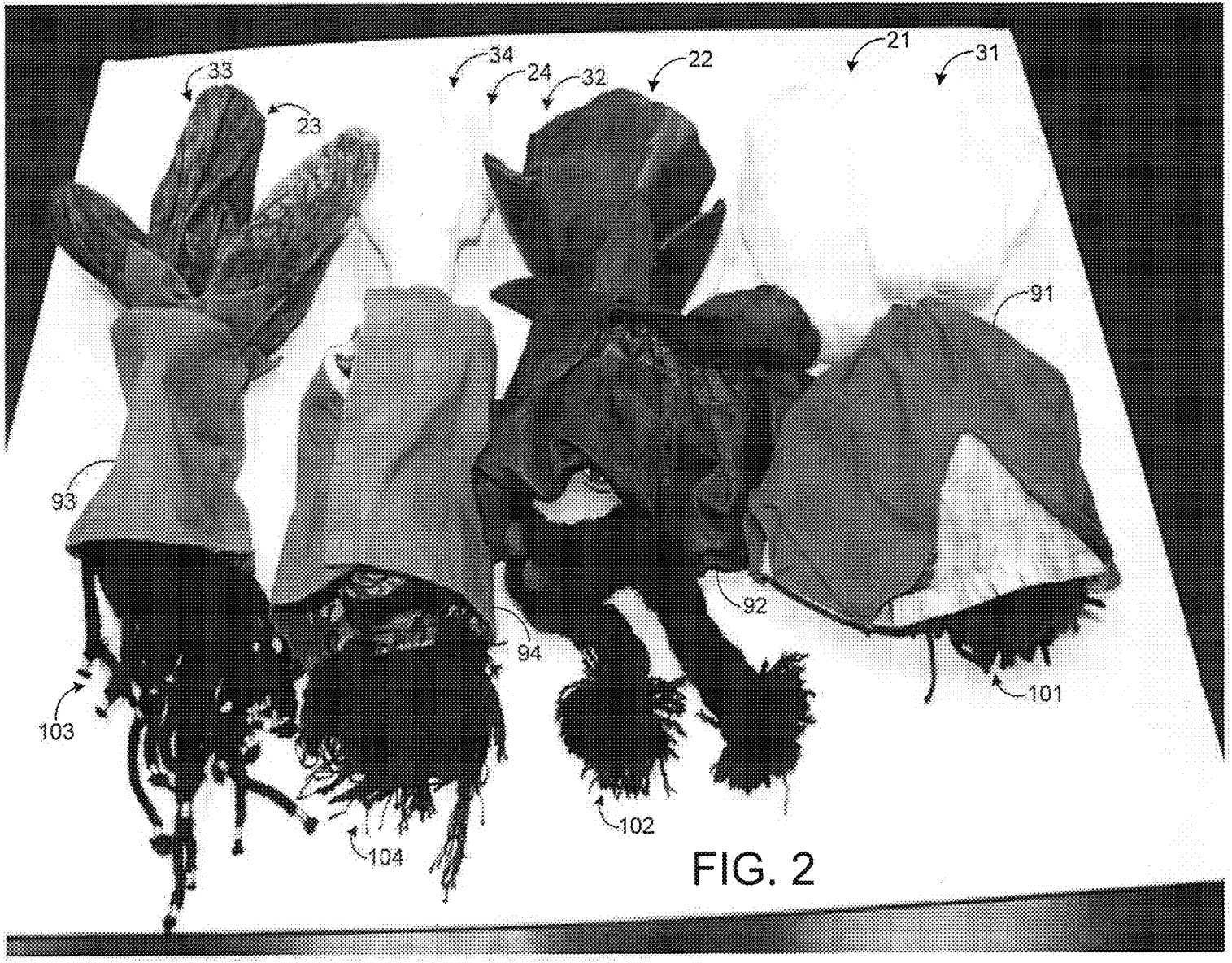
FIG. 2 depicts the toys of FIG. 1 after the toys have been removed from flower pots.

The toys 21-24 have covers 91-94, respectively, that cover various components of the toys 21-24, as will be described in more detail hereafter. In this regard, each artificial flower 31-34 is coupled to a respective doll 101-104 (FIG. 2) that is hidden by a respective one of the covers 91-94 in FIG. 1.

Figure 3:
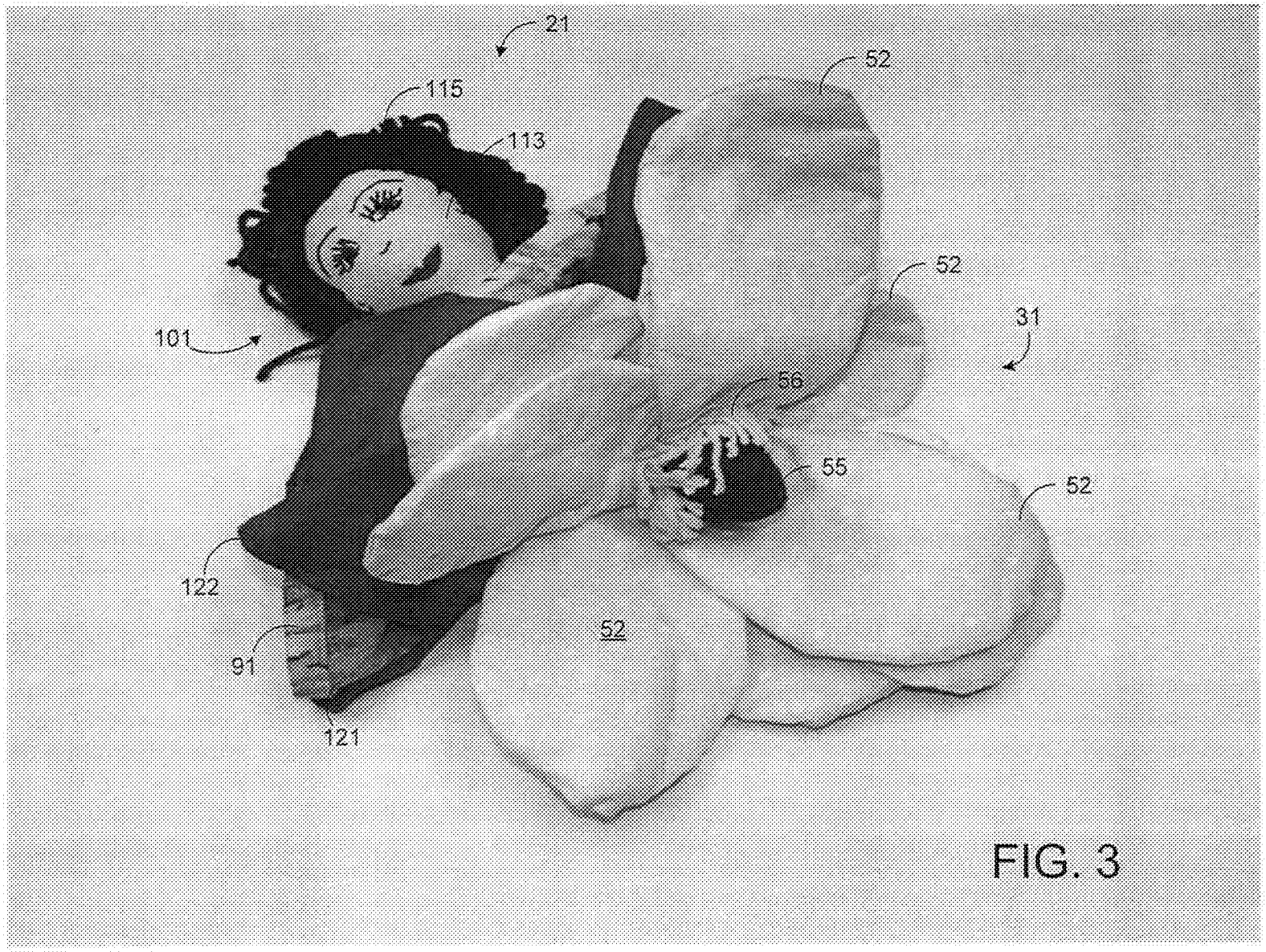
FIG. 3 depicts one of the toys depicted by FIG. 2 after a cover has been pulled during a transformation process for transforming the toy from an artificial flower to a doll.

FIG. 3 depicts the toy 21, which has a doll 101 combined with an artificial flower 31 that resembles a magnolia blossom. The doll 101 has a body 112 (FIG. 4) and a head 113 that is formed at an end of the body 112. The body 112 and head 113 have an outer covering composed of quilters cotton with polyfil stuffing embedded within the outer covering. In other embodiments, other types of materials may be used. Further, the head 113 has facial features, such as eyes, eyebrows, a nose, a mouth, and ears stitched into the head's outer covering. Strands 115 of yarn or other material are sewn or otherwise coupled to the head 113 and serve as hair for the doll 101. In other embodiments, other configurations of the doll 101 and other techniques for including facial features and hair on the head 113 are possible.

The doll 101 has a pair of arms 117 and 118 extending from the body 112. Like the body 112 and head 113, each of the arms 117 and 118 has an outer covering composed of quilters cotton with polyfil stuffing embedded within the outer covering. In other embodiments, other types of materials may be used. Fabric, such as cotton or another material, is sewn or otherwise coupled to the body 112 and/or arms 117, 118 and serves as clothes for the doll 101.

The toy 21 has a cover 91, which is sewn or otherwise coupled to the body 112. In one exemplary embodiment, the cover 91 is a multi-layered fabric (e.g., cotton or other fabric material) such that the cover 91 has a fabric pattern on one side and a different fabric pattern on an opposite side. In this regard, the cover 91 has a first layer 121 of fabric, referred to hereafter as a "doll layer," and a second layer 122 of fabric, referred to hereafter as a "flower layer," and the two layers 121 and 122 are sewn or otherwise coupled together, although it is unnecessary for the layers 121 and 122 to be sewn or otherwise coupled to one another in other embodiments. The doll layer 121 has a fabric pattern that is different than that of the flower layer 122.

The flower layer 122 is exposed, and the doll layer 121 is hidden when the cover 91 is used to hide the doll 101, as shown by FIG. 1. As will be described in more detail hereafter, the doll layer 121 is exposed, and the flower layer 122 is hidden when the cover 91 is used to hide the artificial flower 31. In other embodiments, other types of covers 91 may be used. For example, it is possible for a single layer of fabric to have different patterns on opposite sides. In addition, various materials for the cover 91 are possible, and it is possible for the cover 91 to have the same pattern on both sides.

In one exemplary embodiment, the cover 91 is sewn or otherwise coupled to an end of the body 112 that is opposite of the end at which the head 113 is formed. That is, the cover 91 is coupled to the same end of the body 112 as the artificial flower 31. The cover 91 also may be sewn or otherwise coupled to the proximal ends 53 of any of the petals 52 that are coupled to the body 112. In one exemplary embodiment, the cover 91 forms a loop with one side of the loop coupled to the body 112 via a row of stitches 123 along such side, as shown by FIG. 6.

Figure 4:
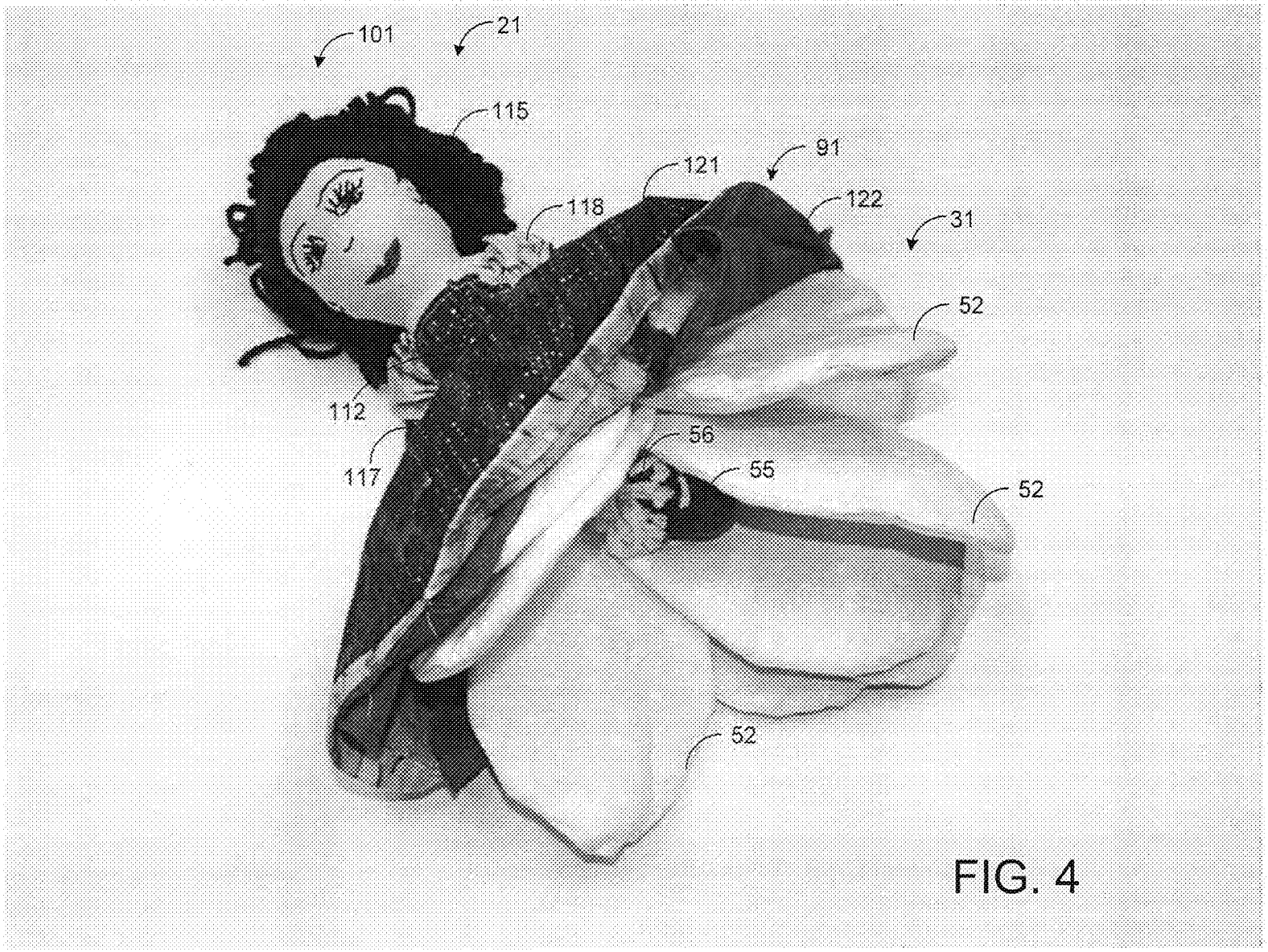
FIG. 4 depicts the toy of FIG. 3 after the cover has been further pulled during the transformation process.
Figure 5:
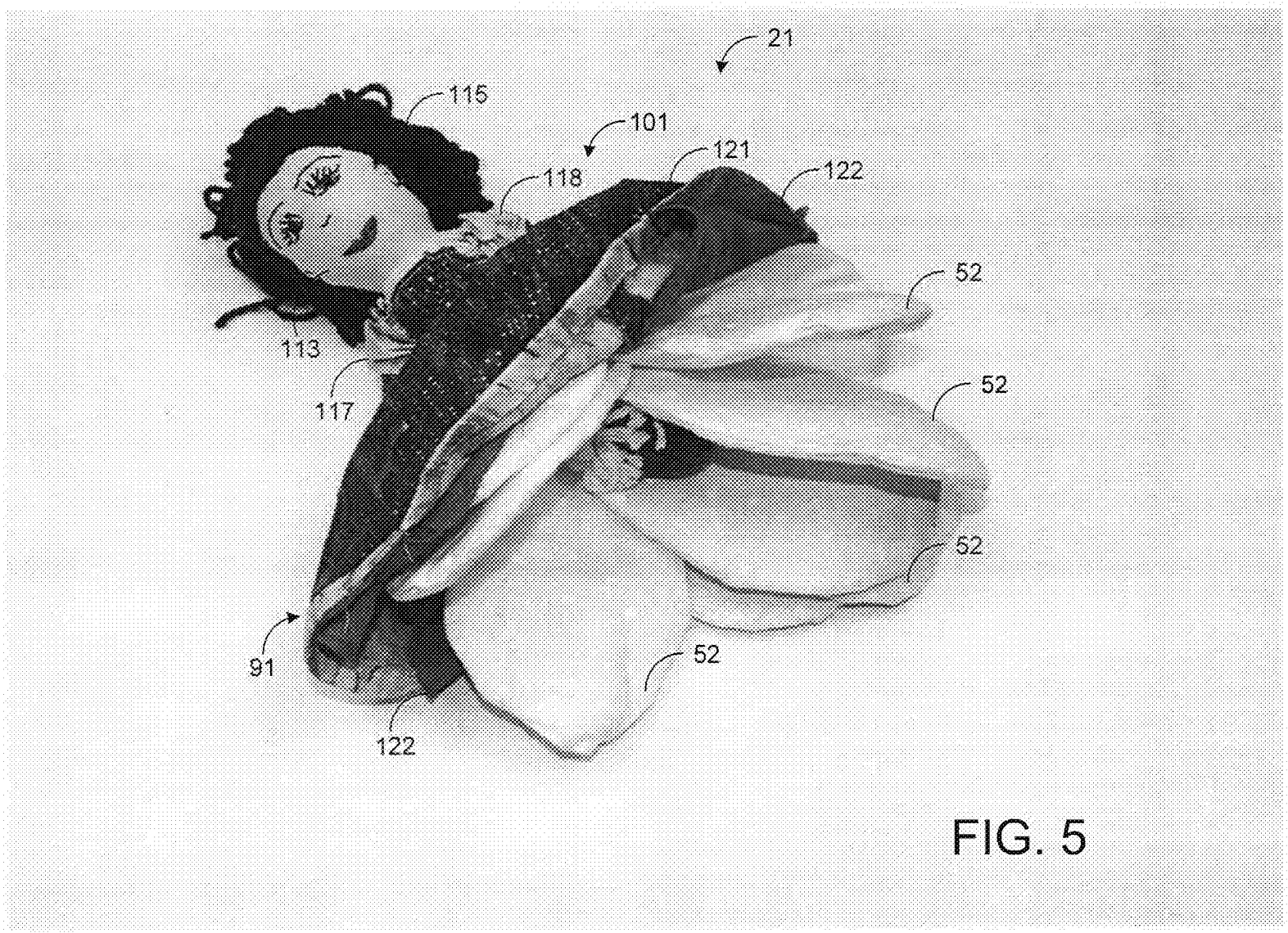
FIG. 5 depicts the toy of FIG. 4 after the cover has been further pulled during the transformation process.

When use of the toy 21 is to be transformed from an artificial flower 31 to a doll 101, the cover 91 is pulled over the artificial flower 31 such that the body 112, head 113, and arms 117, 118 are exposed and the artificial flower 31 is substantially hidden. FIGS. 3-5 show a progression as the cover 91 is pulled over the artificial flower 31. Note that the petals 52 rotate (e.g., bend) about their proximal ends 53 that are coupled to the body 112. Thus, the petals 52 fold over and hide the flower element 55 and the strands 56, as best illustrated in FIG. 5. As a result of the transformation, the toy 21 is effectively converted from an artificial flower 31, as shown by FIG. 1, to a doll 101, as shown by FIG. 6. Note that FIG. 7 depicts a back view of the doll 101.

Figure 6:
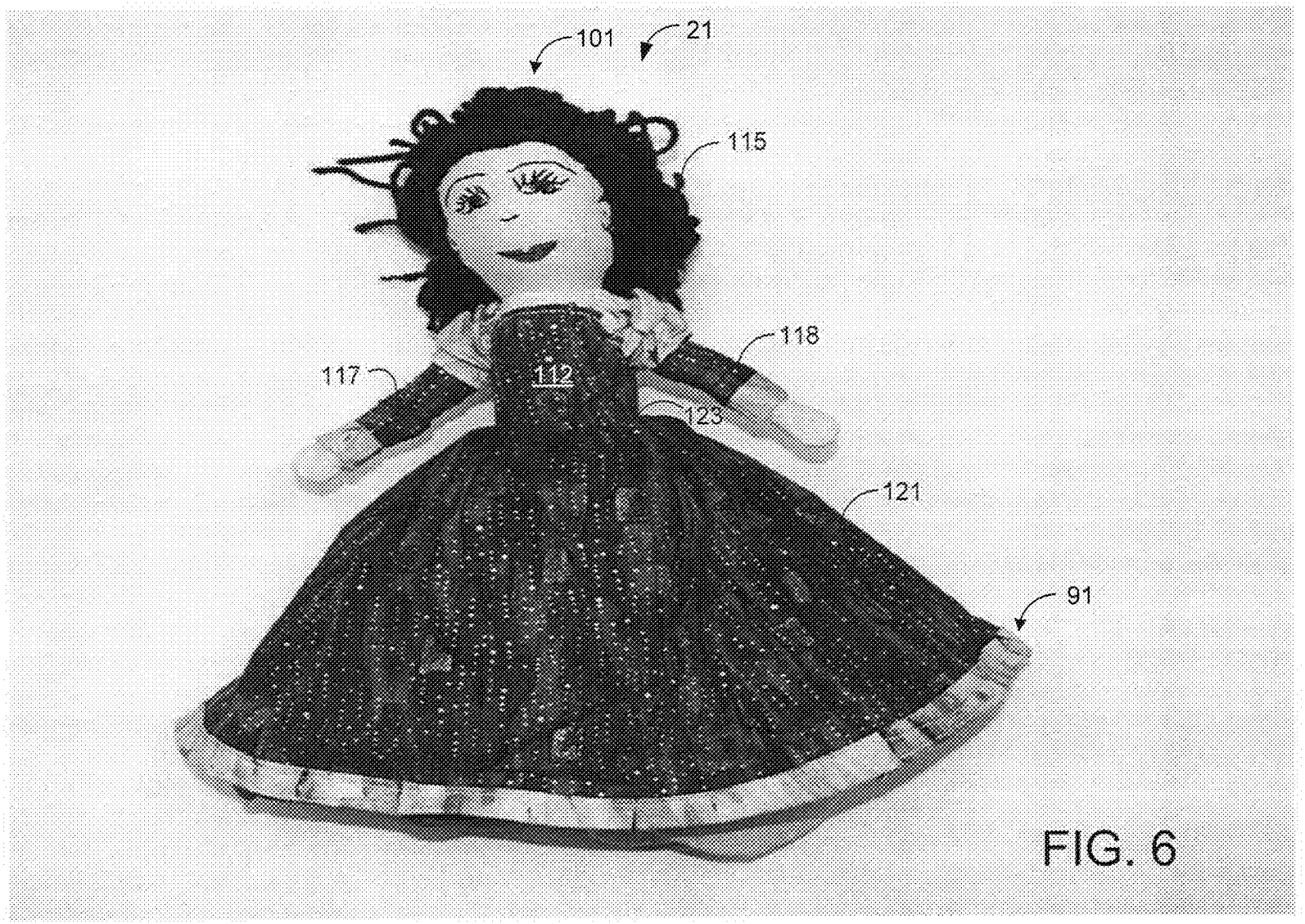
FIG. 6 depicts the toy of FIG. 5 after the cover has been further pulled to complete the transformation process.
Figure 7:
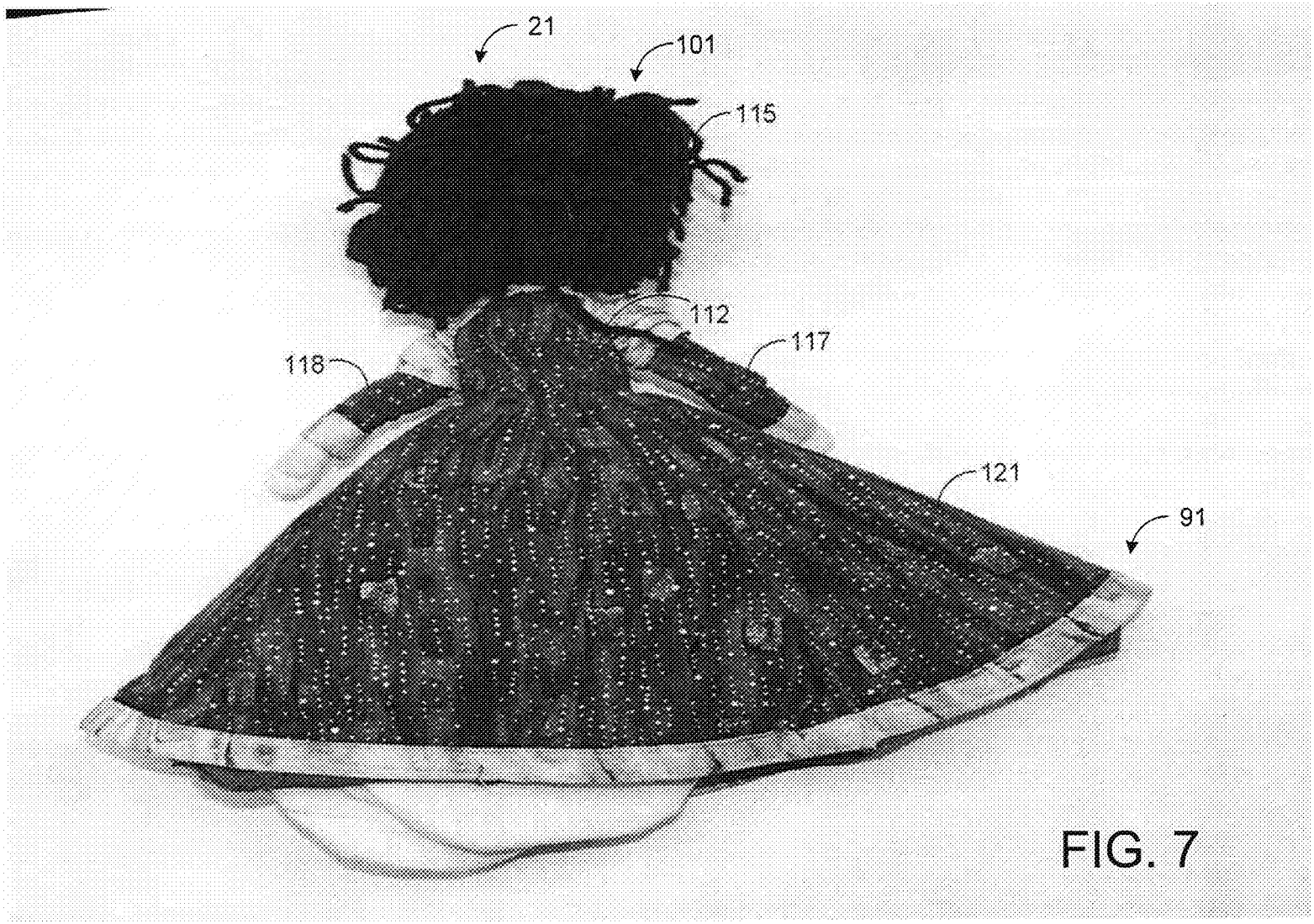
FIG. 7 depicts a back view of the toy depicted in FIG. 6.

As shown by FIGS. 6 and 7, the cover 91 provides a dress and/or other article of clothing for the doll 101. The cover 91 also substantially hides the artificial flower 31 such that it is not readily apparent to a casual observer that the doll 101 is combined with an artificial flower 31. After the transformation process, the doll layer 121 of the cover 91 is exposed and the flower layer 122 of the cover 91 is hidden. If desired, the toy 21 may be transformed back into the artificial flower 31 by pulling the cover 91 in the opposite direction such that the artificial flower 31 is exposed and the doll 101 is substantially hidden by the cover 91. That is, the transformation process described above for the doll 101 may be reversed to transform the toy 21 back into the artificial flower 31.

Accordingly, the toy 21 is selectively usable as a doll 101 or an artificial flower 31. When the toy 21 is be used as a doll 101, the cover 91 is positioned to hide the artificial flower 31 such that it is not readily apparent to a casual observer that the toy 21 has or can be used as an artificial flower 31. When the toy 21 is to be used as an artificial flower 31, the cover 91 is positioned to hide the doll 101 such that it is not readily apparent to a casual observer that the toy 21 has or can be used as a doll 101.

As a mere example, the toy 21 may be used by a child or other person to pretend that a flower represented by the artificial flower 31 transforms into a person or figure represented by the doll 101. In this regard, the child or other person can pull the cover 91 such that the doll 101 is exposed and the artificial flower 31 is hidden. The toy 21 also may be used by a child or other person to pretend that a person or figure represented by the doll 101 transforms into a flower represented by the artificial flower 31. In this regard, the child or other person can pull the cover 91 such that the artificial flower 31 is exposed and the doll 101 is hidden. Further, the toy 21 may be placed in a flower pot 41. Not only does the use of a flower pot 41 help to increase the realism of the artificial flower 31, but the flower pot 41 also provides a convenient and aesthetic way to store the toy 21. Other configurations and uses of the toy 21 are also possible.

Figure 8:
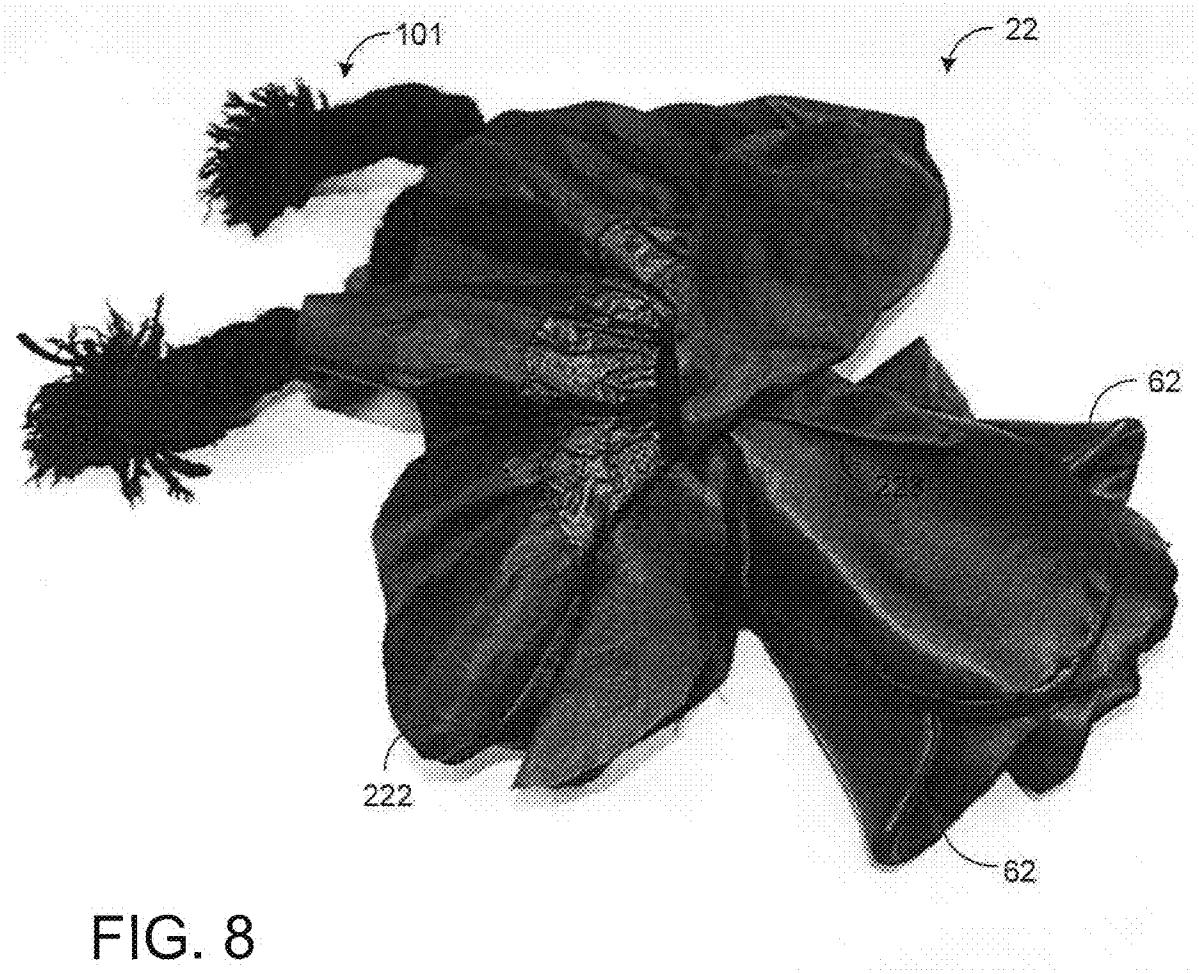
FIG. 8 depicts one of the toys depicted by FIG. 2.
Figure 9:
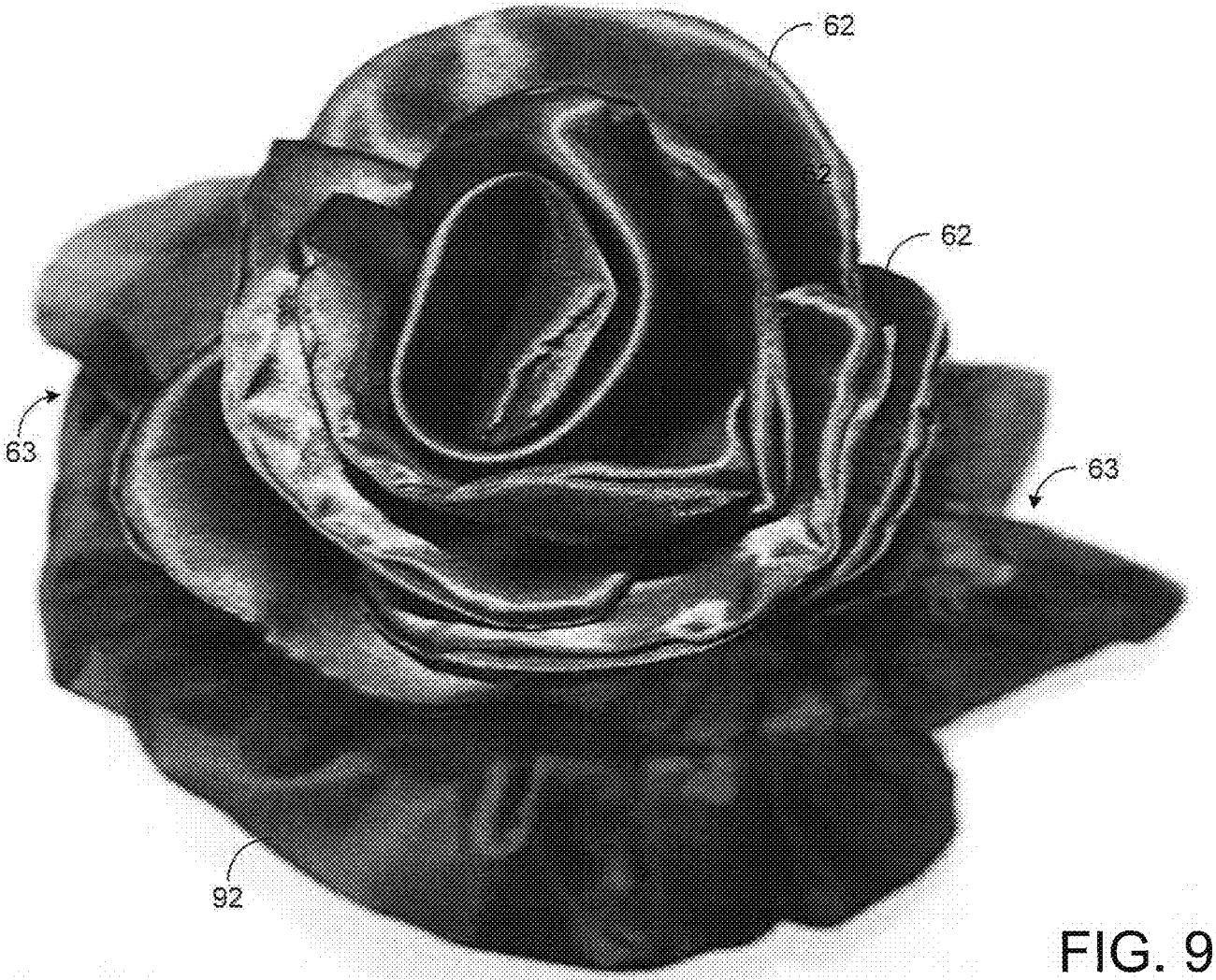
FIG. 9 depicts an exemplary artificial flower of the toy depicted in FIG. 8.

FIG. 8 depicts the toy 22, which has a doll 102 combined with an artificial flower 32 that resembles a rose. FIG. 9 depicts the artificial flower 32. The toy 22 is configured similarly to the toy 21 described above. In this regard, the doll 102 has a body 212 (FIG. 10) and a head 213 that is formed at an end of the body 212 opposite of the end to which the artificial flower 32 is coupled. The body 212 and head 213 have an outer covering composed of quilters cotton with polyfil stuffing embedded within the outer covering. In other embodiments, other types of materials may be used. Further, the head 213 has facial features, such as eyes, eyebrows, a nose, a mouth, and ears stitched into the head's outer covering. Strands 215 of yarn or other material are sewn or otherwise coupled to the head 213 and serve as hair for the doll 102. In other embodiments, other configurations of the doll 102 and other techniques for including facial features and hair on the head 213 are possible.

The doll 102 has a pair of arms 217 and 218 extending from the body 212. Like the body 212 and head 213, each of the arms 217 and 218 has an outer covering composed of quilters cotton with polyfil stuffing embedded within the outer covering. In other embodiments, other types of materials may be used. Fabric, such as cotton or other material, is sewn or otherwise coupled to the body 212 and/or arms 217, 218 and serves as clothes for the doll 102.

The toy 22 has a cover 92, which is sewn or otherwise coupled to the body 212. In one exemplary embodiment, the cover 92 has the same fabric pattern on both sides and may comprise a single layer or, alternatively, multiple layers of fabric. In one exemplary embodiment, the cover 92 has a first layer 221 of fabric, referred to hereafter as a "doll layer," and a second layer 222 of fabric, referred to hereafter as a "flower layer," and the two layers 221 and 222 are sewn or otherwise coupled together, although it is unnecessary for the layers 221 and 222 to be coupled to be sewn or otherwise coupled to one another in other embodiments.

The flower layer 222 is exposed, and the doll layer 221 is hidden when the cover 92 is used to hide the doll 102, as shown by FIG. 1. As will be described in more detail hereafter, the doll layer 221 is exposed, and the flower layer 222 is hidden when the cover 92 is used to hide the artificial flower 32. In other embodiments, other types of covers may be used.

In one exemplary embodiment, the cover 92 is sewn or otherwise coupled to an end of the body 212 that is opposite of the end at which the head 213 is formed. That is, the cover 92 is coupled to the same end of the body 212 as the artificial flower 32. The cover 92 also may be sewn or otherwise coupled to the proximal ends 63 of any of the petals 62 that are coupled to the body 212. In one exemplary embodiment, the cover 92 forms a loop with one side of the loop coupled to the body 212 via a row of stitches 223 along such side, as shown by FIG. 8.

Figure 10:
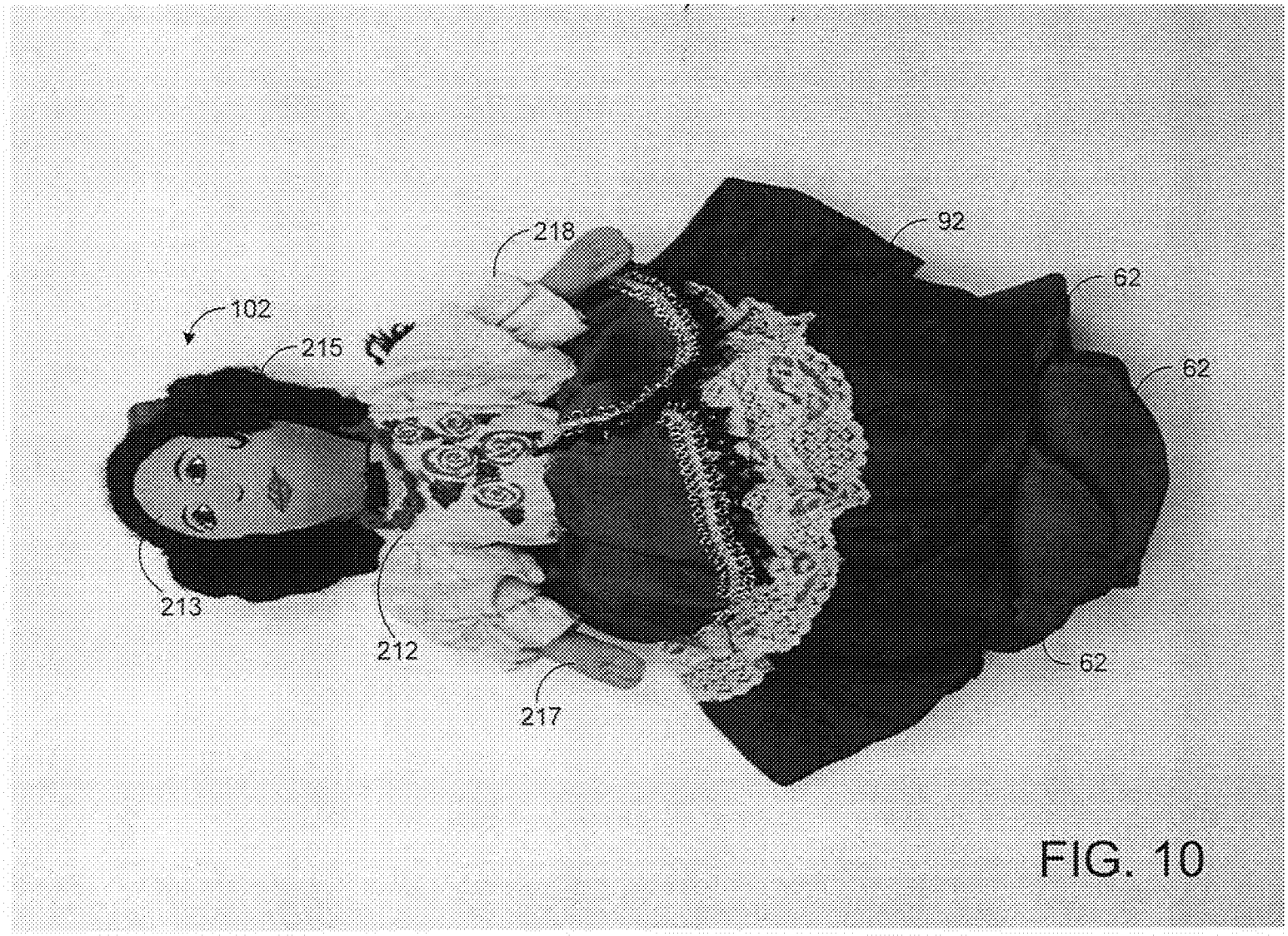
FIG. 10 depicts the toy of FIG. 8 after a cover has been pulled during a transformation process for transforming the toy from an artificial flower to a doll.
Figure 11:
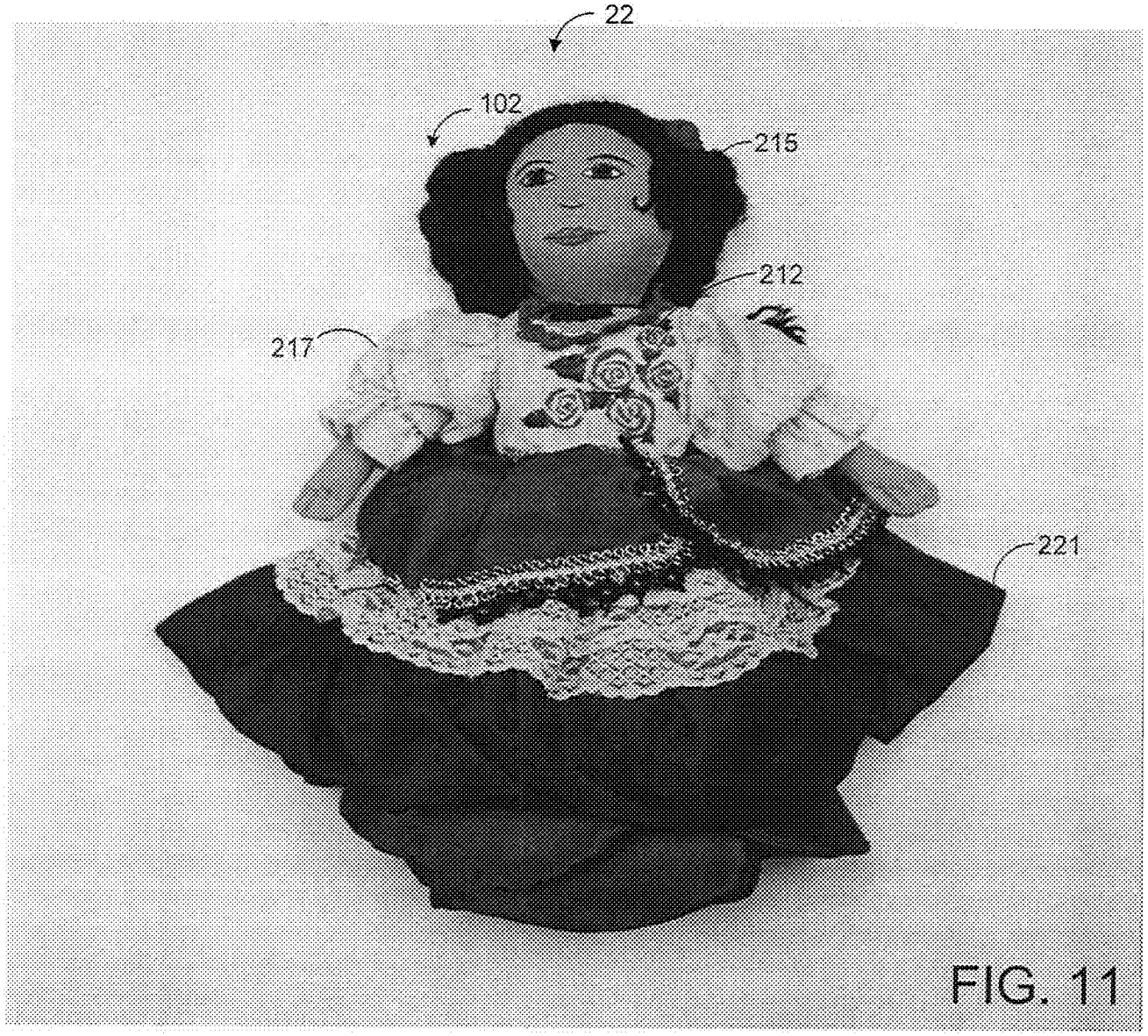
FIG. 11 depicts the toy of FIG. 10 after the cover has been further pulled to complete the transformation process.

When use of the toy 22 is to be transformed from an artificial flower 32 to a doll 102, the cover 92 is pulled over the artificial flower 32 such that the body 212, head 213, and arms 217, 218 are exposed and the artificial flower 32 is substantially hidden. FIGS. 8, 10, and 11 show a progression as the cover 92 is pulled over the artificial flower 32. As a result of the transformation, the toy 22 is effectively converted from an artificial flower 32, as shown by FIG. 1, to a doll 102, as shown by FIG. 11. Note that FIG. 12 depicts a back view of the doll 102.

Figure 12:
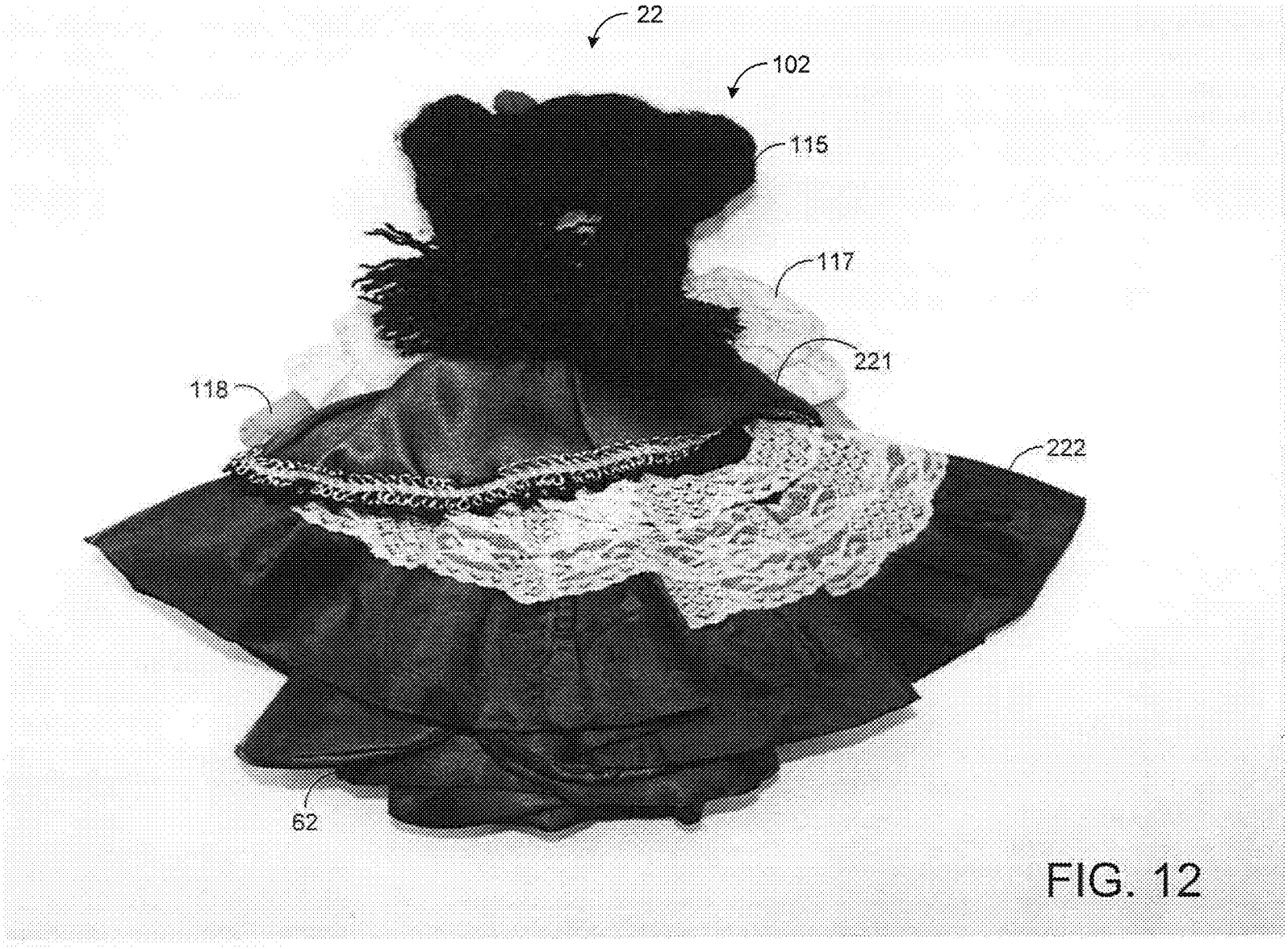
FIG. 12 depicts a back view of the toy depicted in FIG. 11.

As shown by FIGS. 11 and 12, the cover 92 provides a dress for the doll 102. A portion of the doll layer 221 is exposed along with the doll 102 and functions as part of the doll's dress. An additional layer 124 of fabric (e.g., cotton or other material) also functions as part of the doll's dress. The cover 92 also substantially hides the artificial flower 32 such that it is not readily apparent to a casual observer that the doll 102 is combined with an artificial flower 32. After the transformation process, the doll layer 221 is exposed and the flower layer 222 is hidden. If desired, the toy 22 may be transformed back into the artificial flower 32 by pulling the cover 92 in the opposite direction such that the artificial flower 32 is exposed and the doll 102 is substantially hidden by the cover 92. That is, the transformation process described above for the doll 102 may be reversed to transform the toy 22 back into the artificial flower 32.

Accordingly, like the toy 21 described above, the toy 22 is selectively usable as a doll 102 or an artificial flower 32. Thus, the toy 22 may be used by a child or other person to pretend that a flower represented by the artificial flower 32 transforms into a person or figure represented by the doll 102 and vice versa. Other configurations and uses of the toy 22 are also possible.

Figure 13:
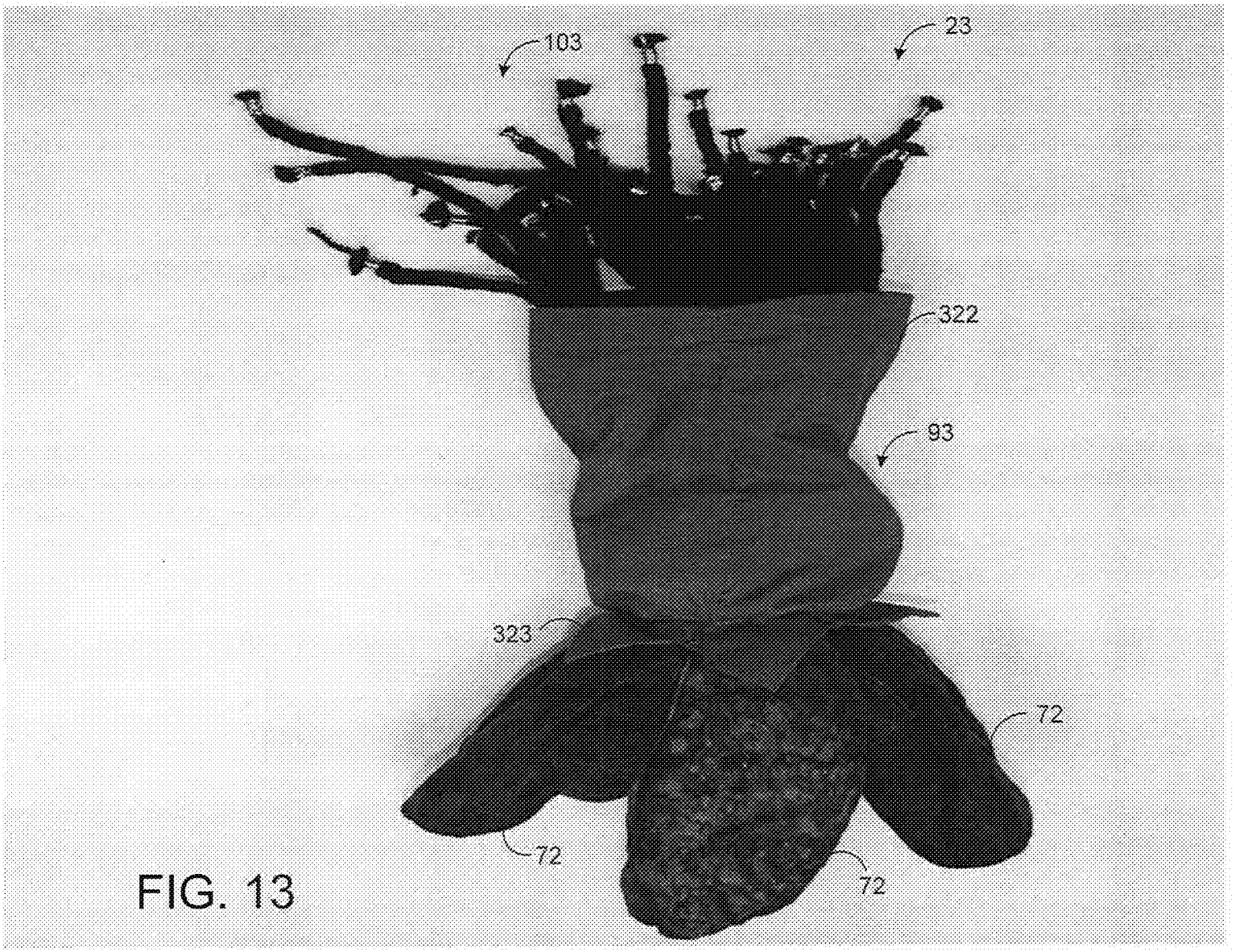
FIG. 13 depicts one of the toys depicted by FIG. 2.
Figure 14:
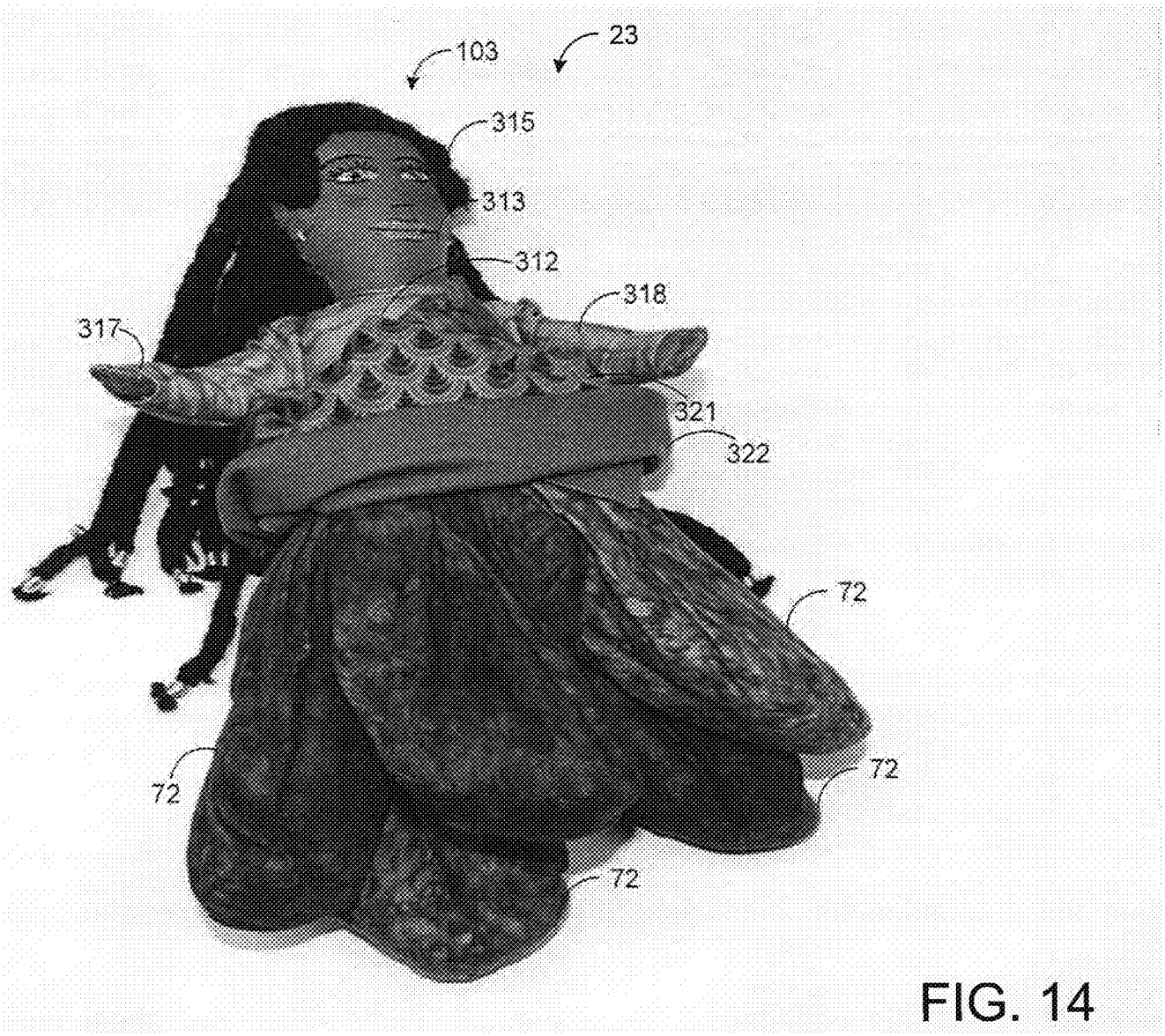
FIG. 14 depicts the toy of FIG. 13 after a cover has been pulled during a transformation process for transforming the toy from an artificial flower to a doll.
Figure 15:
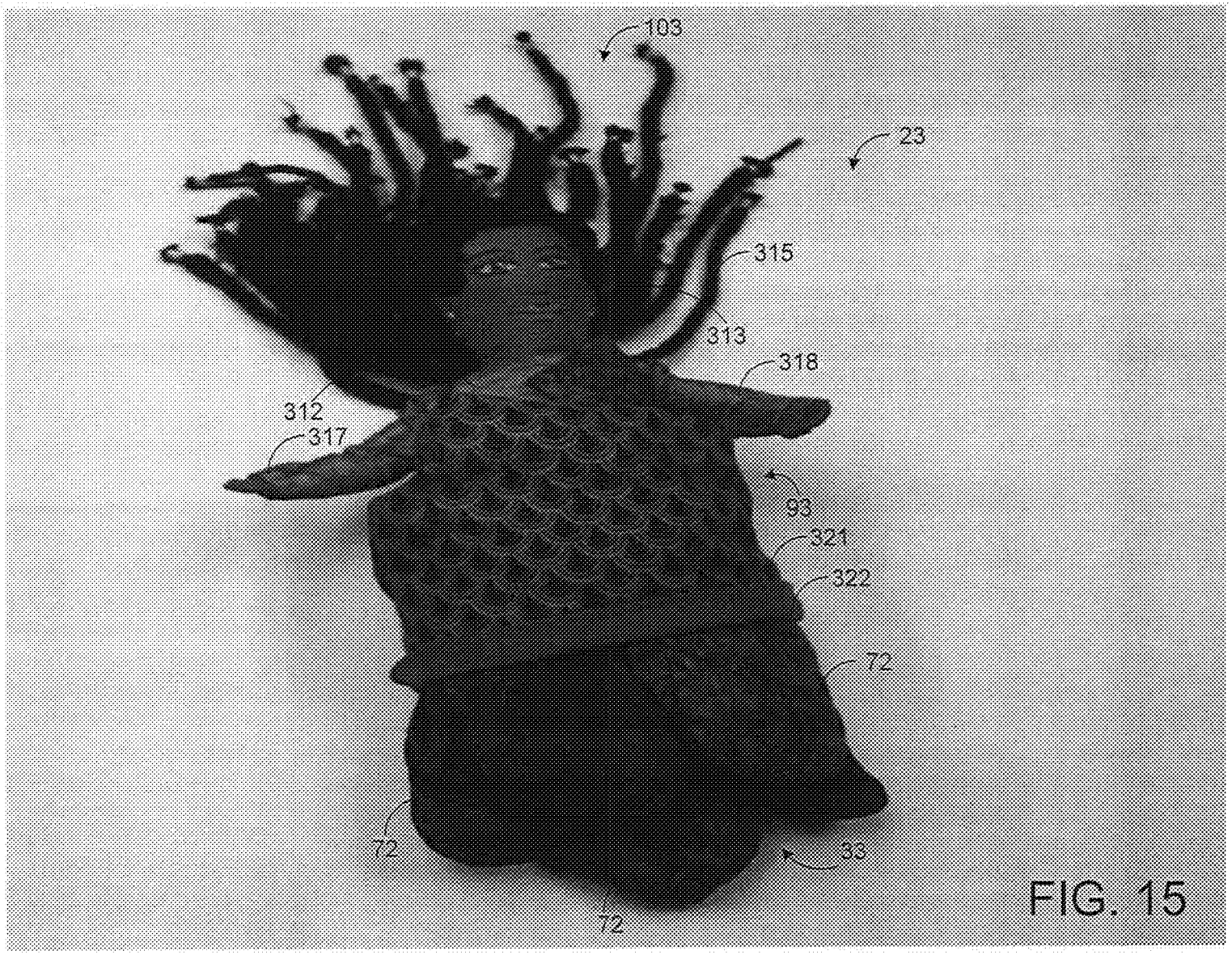
FIG. 15 depicts the toy of FIG. 14 after the cover has been further pulled during the transformation process.

FIG. 13 depicts the toy 23, which has a doll 103 combined with an artificial flower 33 that resembles an African violet. The toy 23 is configured similarly to the toy 21 described above. In this regard, the doll 103 has a body 312 (FIG. 14) and a head 313 that is formed at an end of the body 312 opposite of the end to which the artificial flower 33 is coupled. The body 312 and head 313 have an outer covering composed of quilters cotton with polyfil stuffing embedded within covering. In other embodiments, other types of materials may be used. Further, the head 313 has facial features, such as eyes, eyebrows, a nose, a mouth, and ears stitched into the head's outer covering. Strands 315 of yarn or other material are sewn or otherwise coupled to the head 313 and serve as hair for the doll 103. In other embodiments, other configurations of the doll 103 and other techniques for including facial features and hair on the head 313 are possible.

The doll 103 has a pair of arms 317 and 318 extending from the body 312. Like the body 213 and head 313, each of the arms 317 and 318 has an outer covering composed of quilters cotton with polyfil stuffing embedded within the outer covering. In other embodiments, other types of materials may be used. Fabric, such as cotton or other material, is sewn or otherwise coupled to the body 312 and/or arms 317, 318 and serves as clothes for the doll 103.

The toy 23 has a cover 93, which is sewn or otherwise coupled to the body 312. Like the cover 91 described above, the cover 93 has multiple layers 321 and 322 of fabric, referred to hereafter as the "doll layer 321" and the "flower layer 322." In other embodiments, other types of covers may be used.

In one exemplary embodiment, the cover 93 is sewn or otherwise coupled to an end of the body 312 that is opposite of the end at which the head 313 is formed. That is, the cover 93 is coupled to the same end of the body 312 as the artificial flower 33. The cover 93 also may be sewn or otherwise coupled to the proximal ends 73 of any of the petals 72 that are coupled to the body 312. In one exemplary embodiment, the cover 93 forms a loop with one side of the loop coupled to the body 312 via a row of stitches 323 along such side, as shown by FIG. 13.

Figure 16:
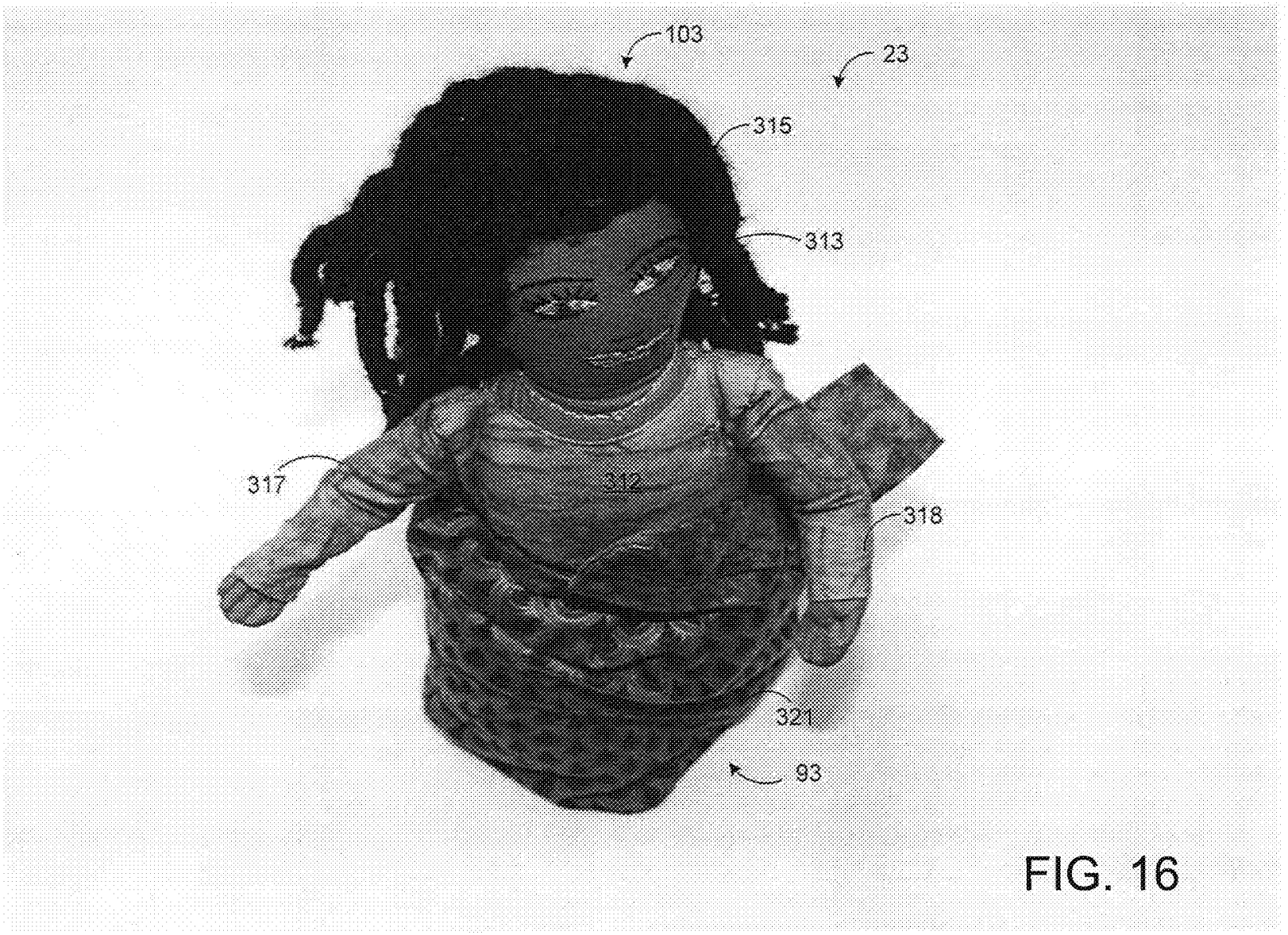
FIG. 16 depicts the toy of FIG. 15 after the cover has been further pulled to complete the transformation process.

When use of the toy 23 is to be transformed from an artificial flower 33 to a doll 103, the cover 93 is pulled over the artificial flower 33 such that the body 312, head 313, and arms 317, 318 are exposed and the artificial flower 33 is substantially hidden. FIGS. 13-16 show a progression as the cover 93 is pulled over the artificial flower 33. As a result of the transformation, the toy 23 is effectively converted from an artificial flower 33, as shown by FIG. 1, to a doll 103, as shown by FIG. 16. Note that FIG. 17 depicts a back view of the doll 103.

Figure 17:
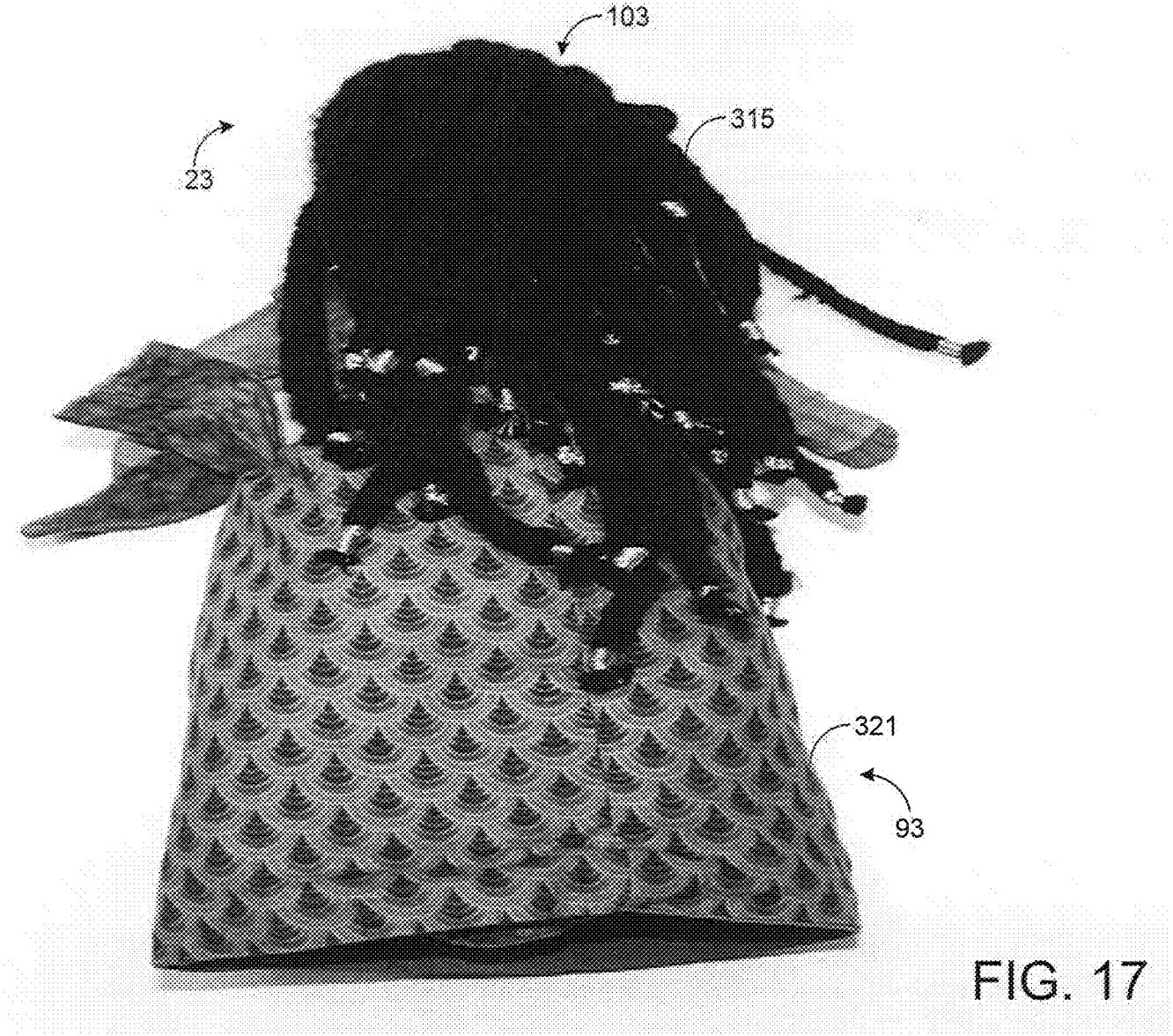
FIG. 17 depicts a back view of the toy depicted in FIG. 16.

As shown by FIGS. 16 and 17, the cover 93 provides a dress for the doll 103. The cover 93 also substantially hides the artificial flower 33 such that it is not readily apparent to a casual observer that the doll 103 is combined with an artificial flower 33. After the transformation process, the doll layer 321 is exposed and the flower layer 322 is hidden. If desired, the toy 23 may be transformed back into the artificial flower 33 by pulling the cover 93 in the opposite direction such that the artificial flower 33 is exposed and the doll 103 is substantially hidden by the cover 93. That is, the transformation process described above for the doll 103 may be reversed to transform the toy 23 back into the artificial flower 33.

Accordingly, like the toy 21 described above, the toy 23 is selectively usable as a doll 103 or an artificial flower 33. Thus, the toy 23 may be used by a child or other person to pretend that a flower represented by the artificial flower 33 transforms into a person or figure represented by the doll 103 and vice versa. Other configurations and uses of the toy 23 are also possible.

Figure 18:
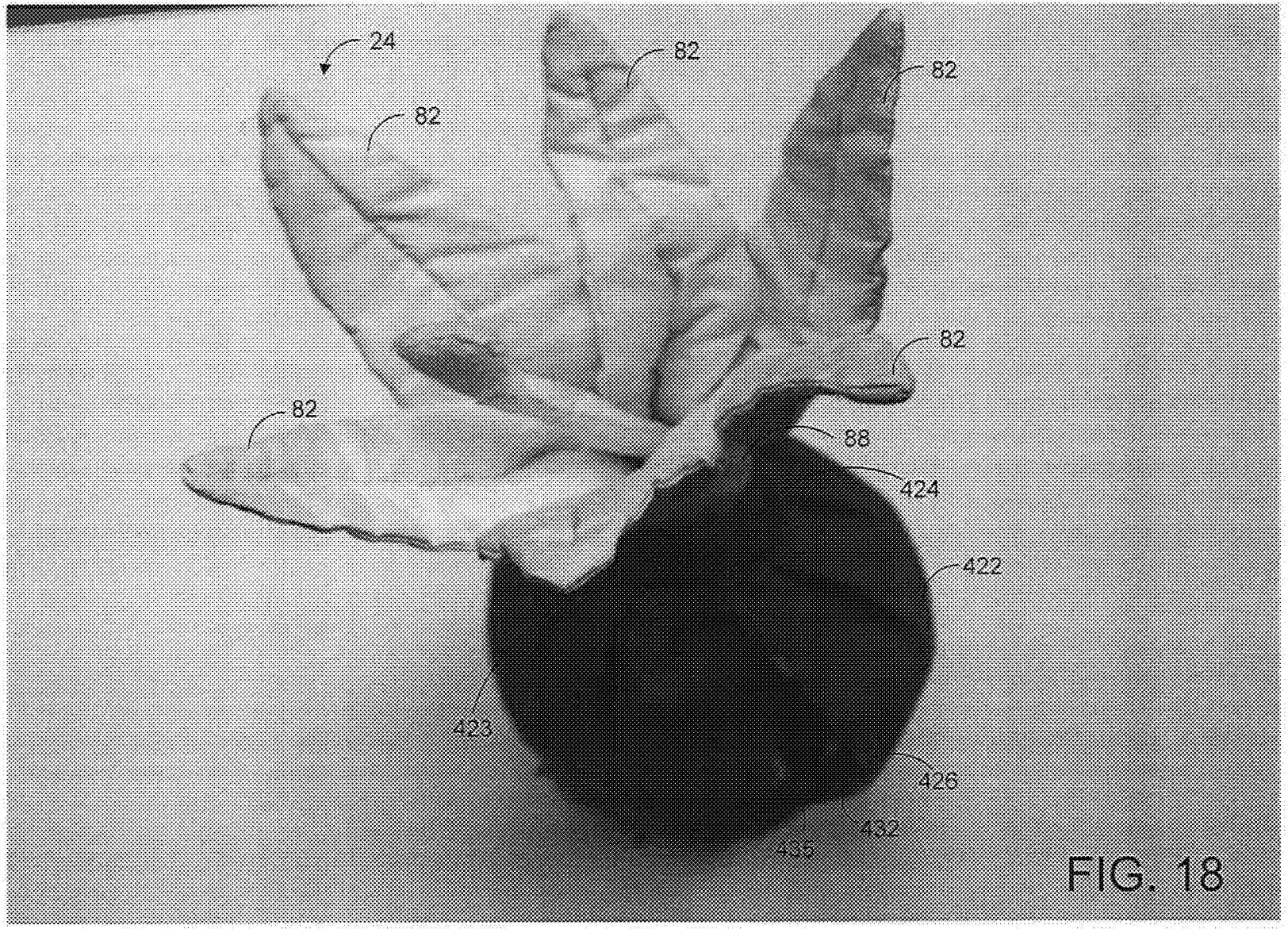
FIG. 18 depicts one of the toys depicted by FIG. 2.
Figure 19:
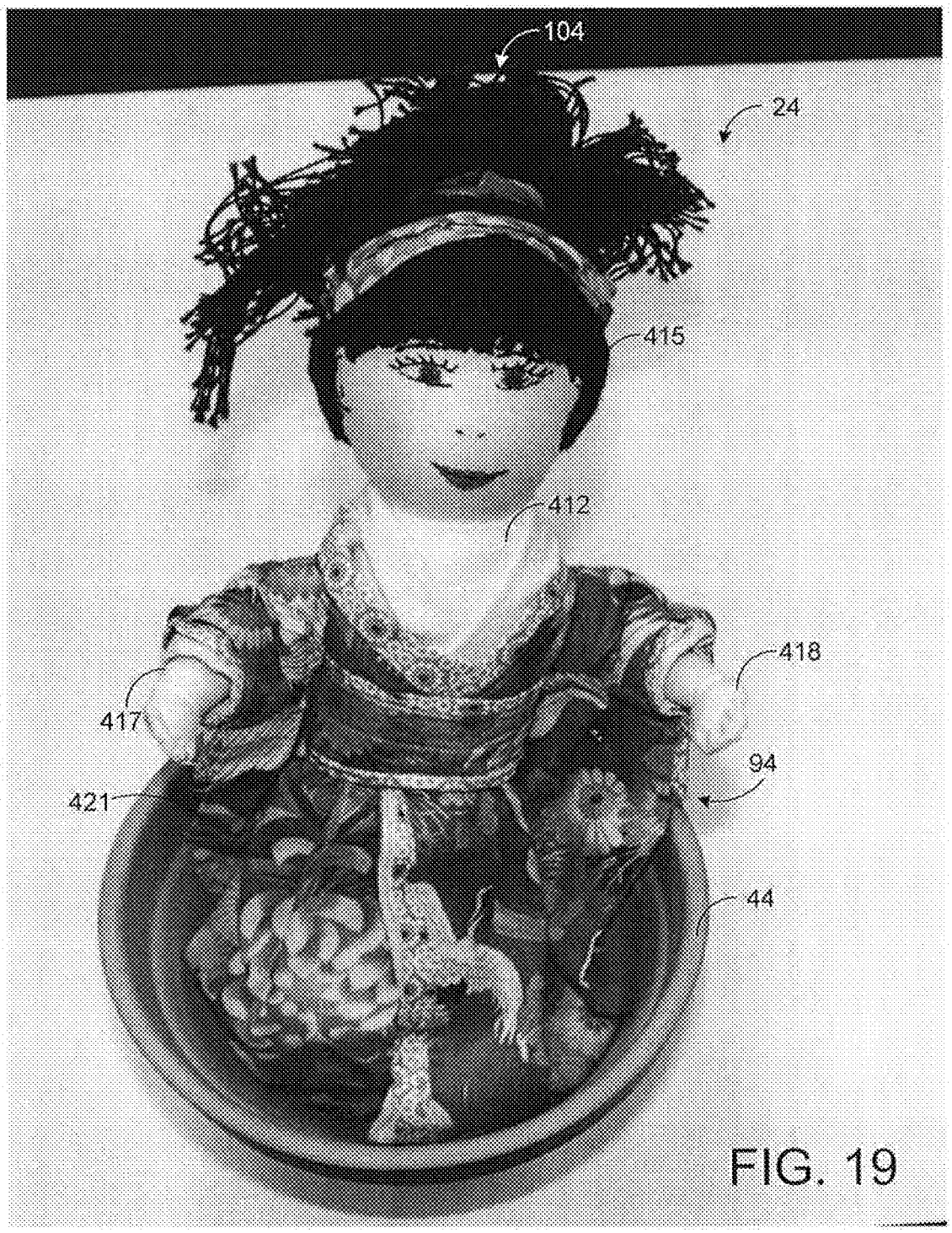
FIG. 19 depicts the toy of FIG. 18 after the toy has been transformed from an artificial flower to a doll and placed in a flower pot.

FIG. 18 depicts the toy 24, which has a doll 104 combined with an artificial flower 34 that resembles a lily. The toy 24 is configured similarly to the toy 21 described above such that the toy 24 may be transformed from an artificial flower 34, as shown by FIG. 18, into a doll 104, as shown by FIG. 19. In this regard, referring to FIG. 19, the doll 104 has a body 412 and a head 413 that is formed at an end of the body 412 opposite of the end to which the artificial flower 34 is coupled. The body 412 and head 413 have an outer covering composed of quilters cotton with polyfil stuffing embedded within the outer covering. In other embodiments, other types of materials may be used. Further, the head 413 has facial features, such as eyes, eyebrows, a nose, a mouth, and ears stitched into the head's outer covering. Strands 415, such as fringed threads of cotton, polyester, or other material, are sewn or otherwise coupled to the head 413 and serve as hair for the doll 104. In other embodiments, other configurations of the doll 104 and other techniques for including facial features and hair on the head 413 are possible.

The doll 104 has a pair of arms 417 and 418 extending from the body 412. Like the body 412 and head 413, each of the arms 417 and 418 has an outer covering composed of quilters cotton with polyfil stuffing embedded within the outer covering. In other embodiments, other types of materials may be used. Fabric, such as cotton or another material, is sewn or otherwise coupled to the body 412 and/or arms 417, 418 and serves as clothes for the doll 104.

The toy 24 has a cover 94, which is sewn or otherwise coupled to the body 412. Like the cover 91 described above, the cover 94 has multiple layers 421 and 422 of fabric, referred to hereafter as the "doll layer 421" and the "flower layer 422." In other embodiments, other types of covers may be used.

In one exemplary embodiment, the cover 94 is sewn or otherwise coupled to an end of the body 412 that is opposite of the end at which the head 413 is formed. That is, the cover 94 is coupled to the same end of the body 412 as the artificial flower 34. In the exemplary embodiment shown by FIG. 18, the cover 94 is sewn to the body 412 via a row of stitches 423, but other techniques for coupling the cover 94 to the body 412 are possible. The cover 94 is also sewn to the base 88 of the artificial flower 34 via a row of stitches 424.

In addition, the cover 94 has ends 425 and 426 that are separated thereby forming a slit 429 in the cover 94. Thus, the portion of the cover 94 below the row of stitches 423 in FIG. 18 does not form a continuous loop. An attachment assembly 432 detachably couples the ends 425 and 426 to each other. In a state, referred to hereafter as the "attached state," the attachment assembly 432 couples the ends 425 and 426 to each other thereby holding the ends 425 and 426 in place relative to one another. In another state, referred to hereafter as the "detached state," the attachment assembly 432 no longer couples the ends 425 and 426 to each other.

Figure 20:
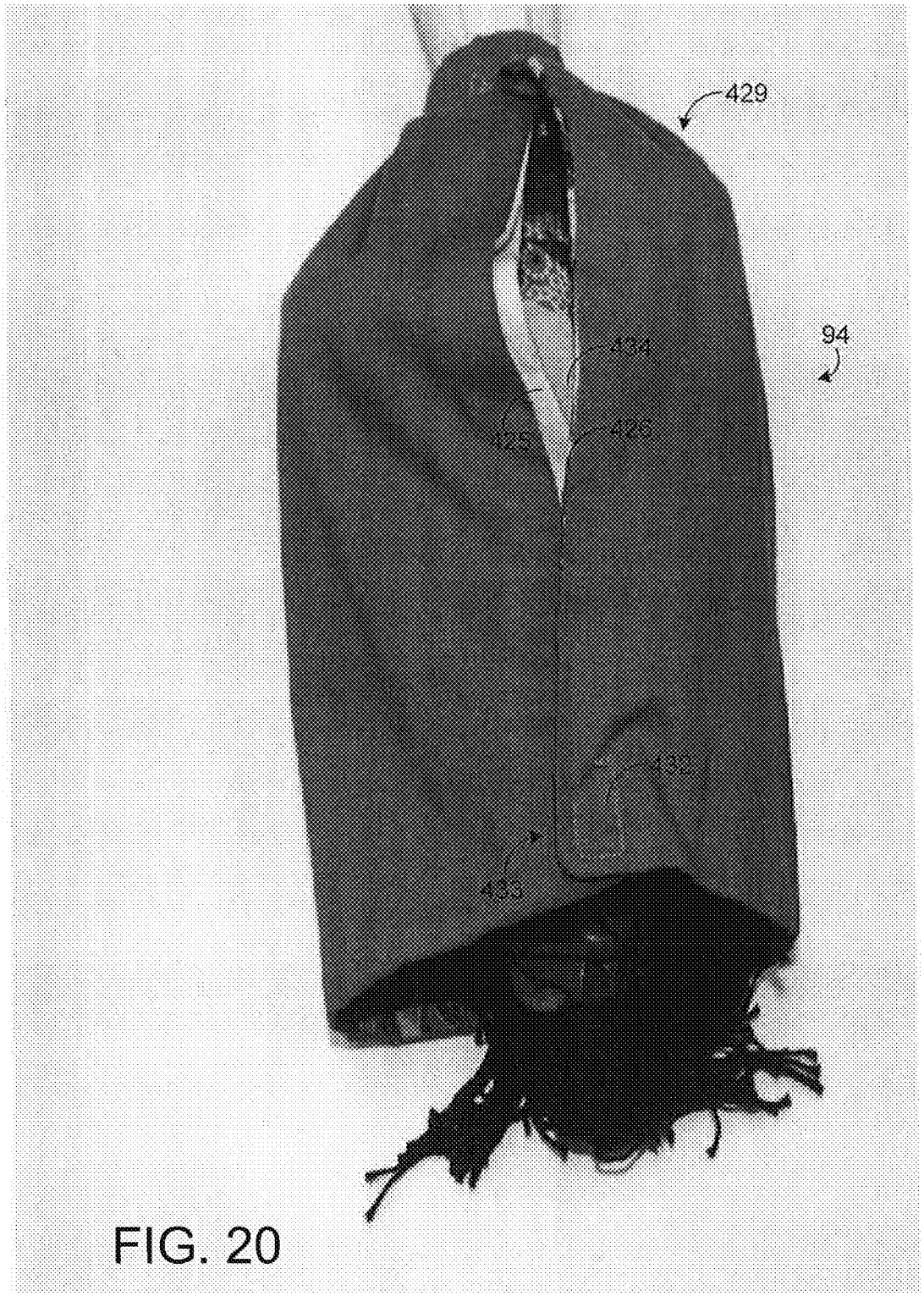
FIG. 20 depicts a cover of the toy of FIG. 18.

Various types of devices may be used to implement the attachment assembly 432. For example, the attachment assembly 432 may comprise at least one pin or, alternatively, a hook and loop arrangement. Also, the attachment assembly 432 may comprise a button that can be inserted through a button hole. For example, the end 425 may have a button sewed thereon, and the end 426 may have a hole through which the button may pass in order to secure the end 425 to the end 426. In one exemplary embodiment, the attachment assembly 432 comprises a pair of Velcro strips 433 and 434, as shown by FIG. 20, although other numbers of Velcro strips or other types of strips may be used in other embodiments. One strip 433 is sewn or otherwise coupled to the end 425, and the other strip 434 is sewn or otherwise coupled to the end 426. The strip 433 can be detachably coupled to the strip 434 by pressing the two strips 433 and 434 together by hand or otherwise thereby transitioning the attachment assembly 426 from the detached state to the attached state. Further, the strips 433 and 434 can be detached from one another by pulling the two strips 433 and 434 apart by hand or otherwise thereby transitioning the attachment assembly 426 from the attached state to the detached state.

Generally, the strips 433 and 434 are detachably coupled to each other when the toy 24 is to be used as either an artificial flower 34 or doll 104. However, when the toy 24 is to be transformed from an artificial flower 34 to a doll 104 or vice versa, the strips 433 and 434 are separated in order to facilitate the transformation. The configuration of a cover 94 with a slit 429 may be particularly beneficial for a cover 94 having a relatively small girth. In such a case, pulling of the cover 94 over the artificial flower 34 and/or doll 104 may be difficult and/or cumbersome particularly if the girth of the artificial flower 34 and/or doll 104 is close to that of the cover 94. The slit 429 generally allows the cover 94 to accommodate artificial flowers 34 and/or dolls 104 of wider girths than would otherwise be possible or desired.

When use of the toy 24 is to be transformed from an artificial flower 34 to a doll 104, the strips 433 and 434 are separated, and the cover 94 is pulled over the artificial flower 34 such that the body 412, head 413, and arms 417, 418 are exposed and the artificial flower 34 is substantially hidden. The strips 433 and 434 may then be detachably coupled to each other, if desired. FIGS. 21-24 show a progression as the cover 94 is pulled over the artificial flower 43.

Figure 21:
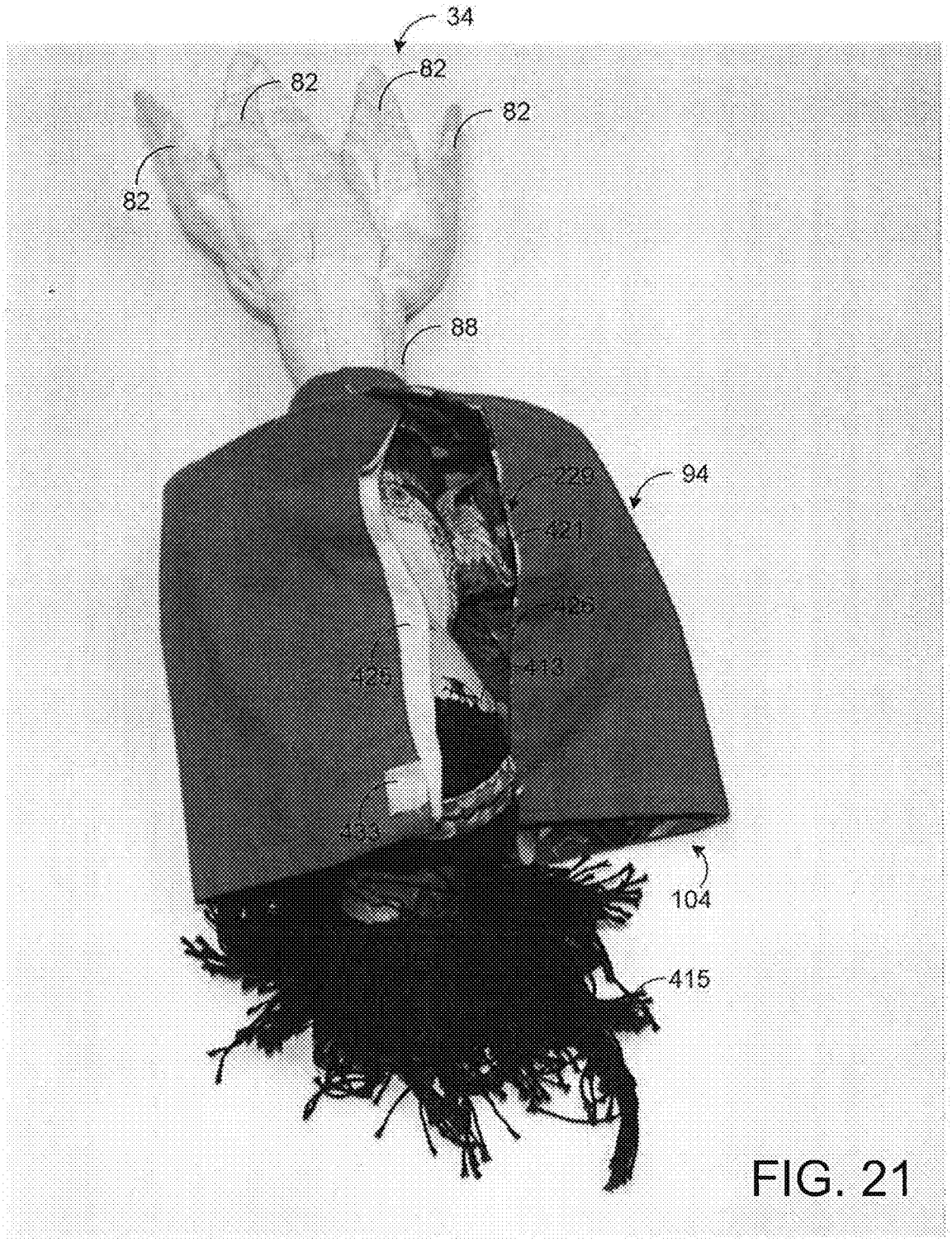
FIG. 21 depicts the toy of FIG. 18 after an attachment assembly has been transitioned to a detached state.
Figure 22:
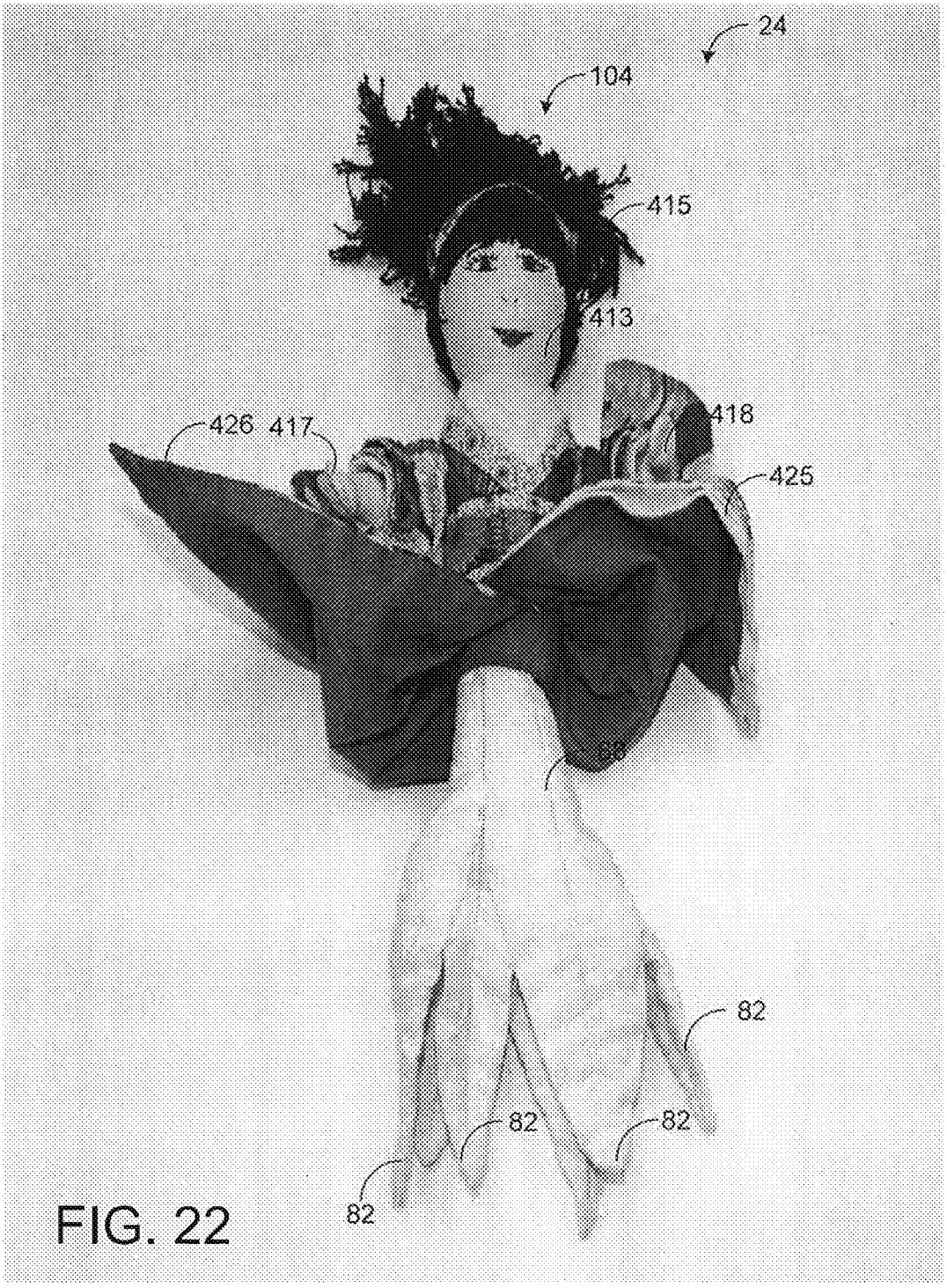
FIG. 22 depicts the toy of FIG. 21 after a cover has been pulled during a transformation process for transforming the toy from an artificial flower to a doll.
Figure 23:
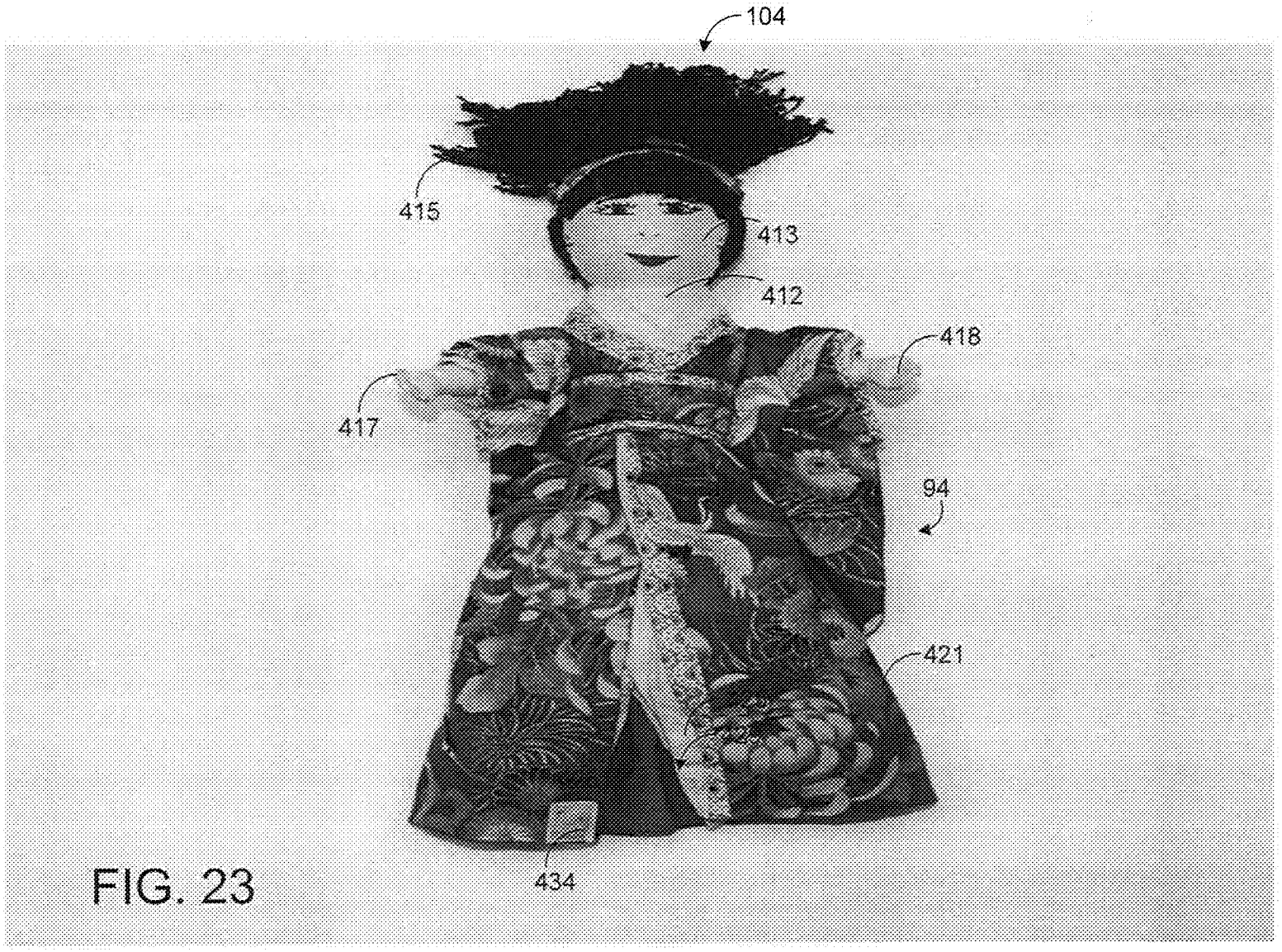
FIG. 23 depicts the toy of FIG. 22 after the cover has been further pulled during the transformation process such that the artificial flower is substantially hidden.
Figure 24:
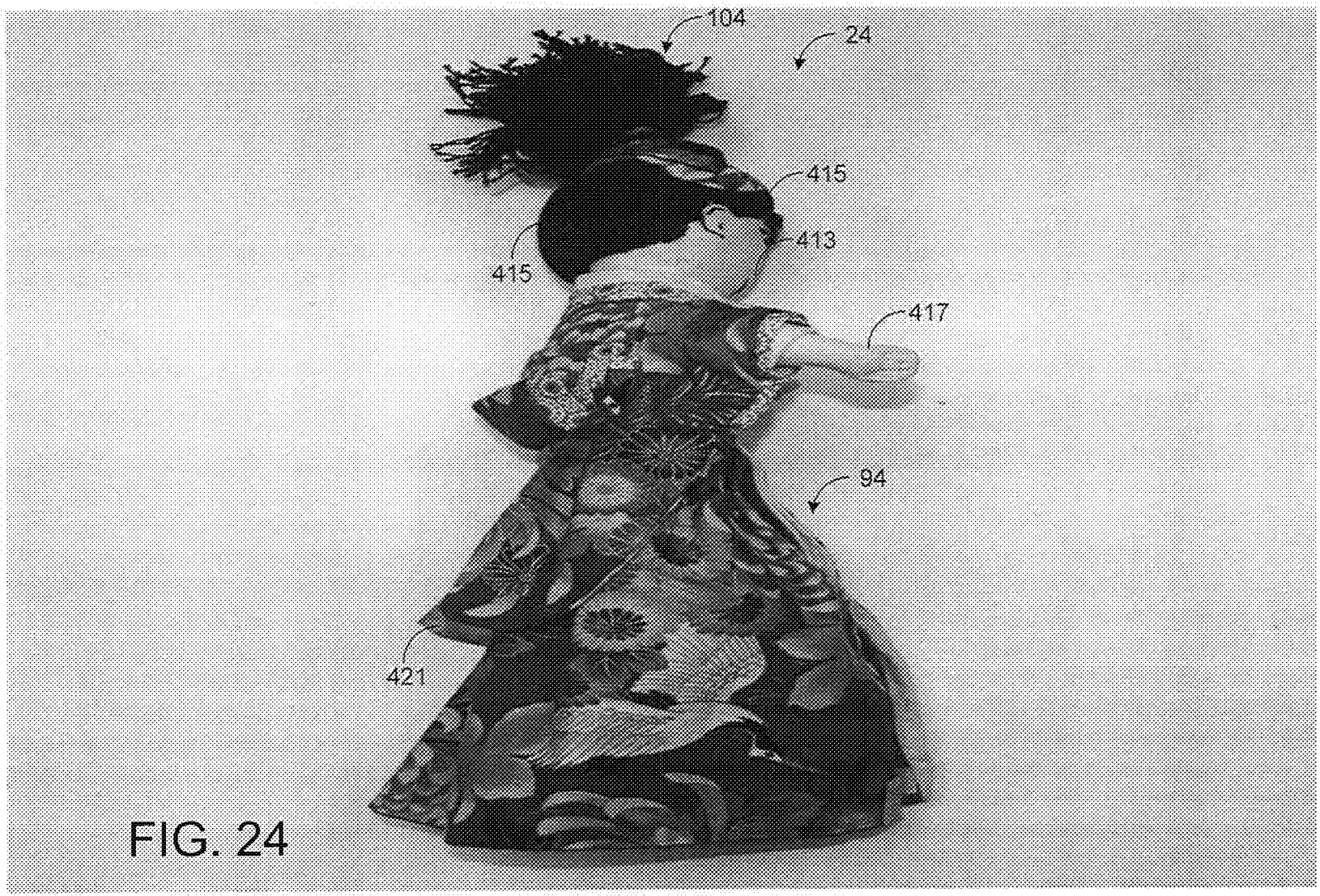
FIG. 24 depicts the toy of FIG. 23 after the attachment assembly has been transitioned to an attached state.

In this regard, the strips 433 and 434 are separated, as shown by FIG. 21. The cover 94 is then pulled to expose the doll 104, as shown by FIG. 22. Pulling of the cover 94 continues until the artificial flower 34 is substantially hidden by the cover 94, as shown by FIG. 23. The strips 433 and 434 are then detachably coupled to each other, as shown by FIG. 24, thereby coupling the ends 425 and 426 of the cover 94 to each other. As a result of the transformation, the toy 24 is effectively converted from an artificial flower 34, as shown by FIG. 1, to a doll 104, as shown by FIG. 24. Note that FIG. 25 depicts a back view of the doll 104.

Figure 25:
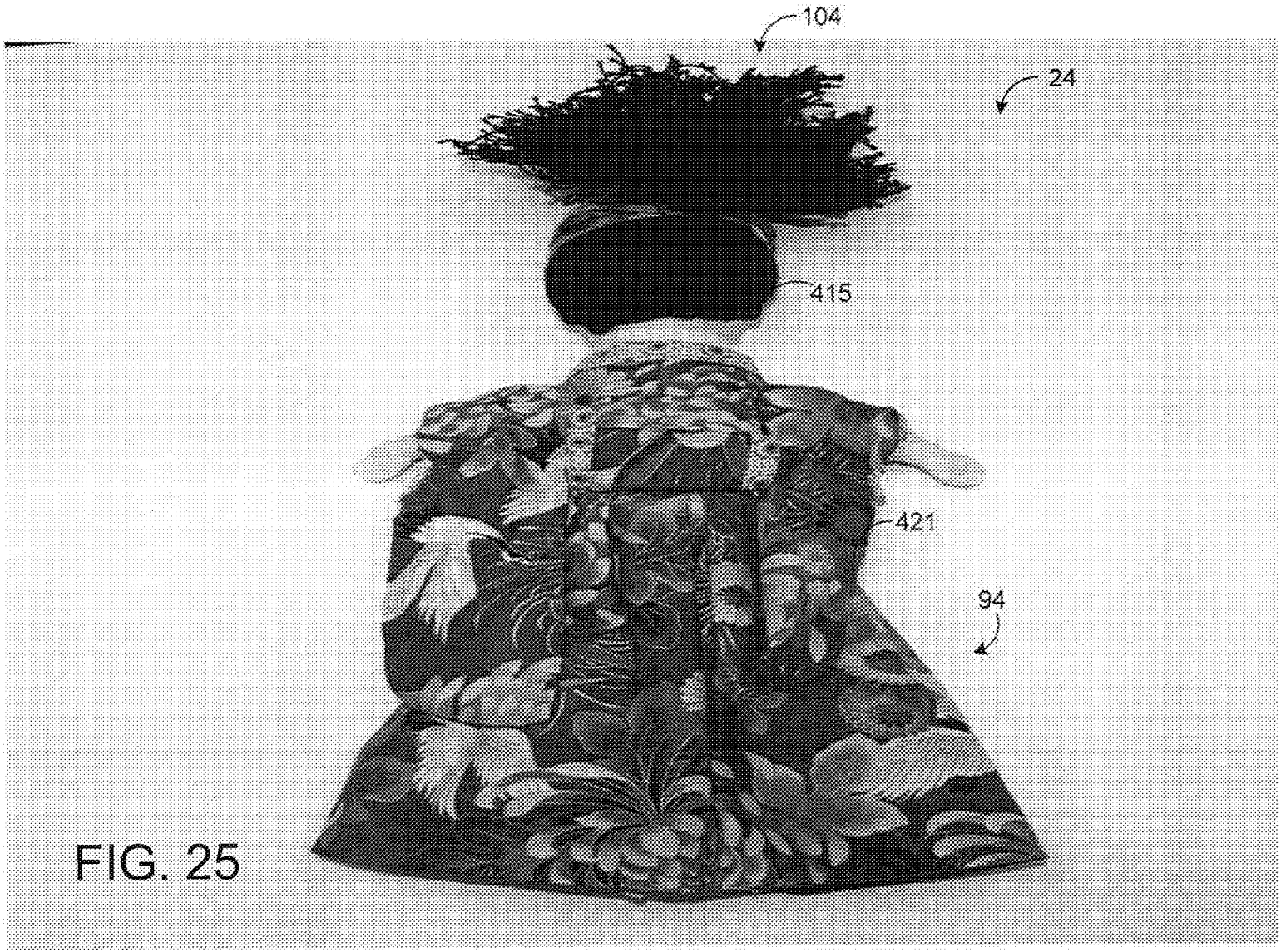
FIG. 25 depicts a back view of the toy depicted in FIG. 24.

As shown by FIGS. 24 and 25, the cover 94 provides a dress for the doll 104. The cover 94 also substantially hides the artificial flower 34 such that it is not readily apparent to a casual observer that the doll 104 is combined with an artificial flower 34. After the transformation process, the doll layer 421 is exposed and the flower layer 422 is hidden. If desired, the toy 24 may be transformed back into the artificial flower 34 by separating the strips 433, 434 and pulling the cover 94 in the opposite direction such that the artificial flower 34 is exposed and the doll 104 is substantially hidden by the cover 94. If desired, the strips 433 and 434 may be detachably coupled to each other after the cover 94 has been so pulled.

Accordingly, like the toy 21 described above, the toy 24 is selectively usable as a doll 104 or an artificial flower 34.

Thus, the toy 24 may be used by a child or other person to pretend that a flower represented by the artificial flower 34 transforms into a person or figure represented by the doll 104 and vice versa. Other configurations and uses of the toy 24 are also possible.

Figure 26:
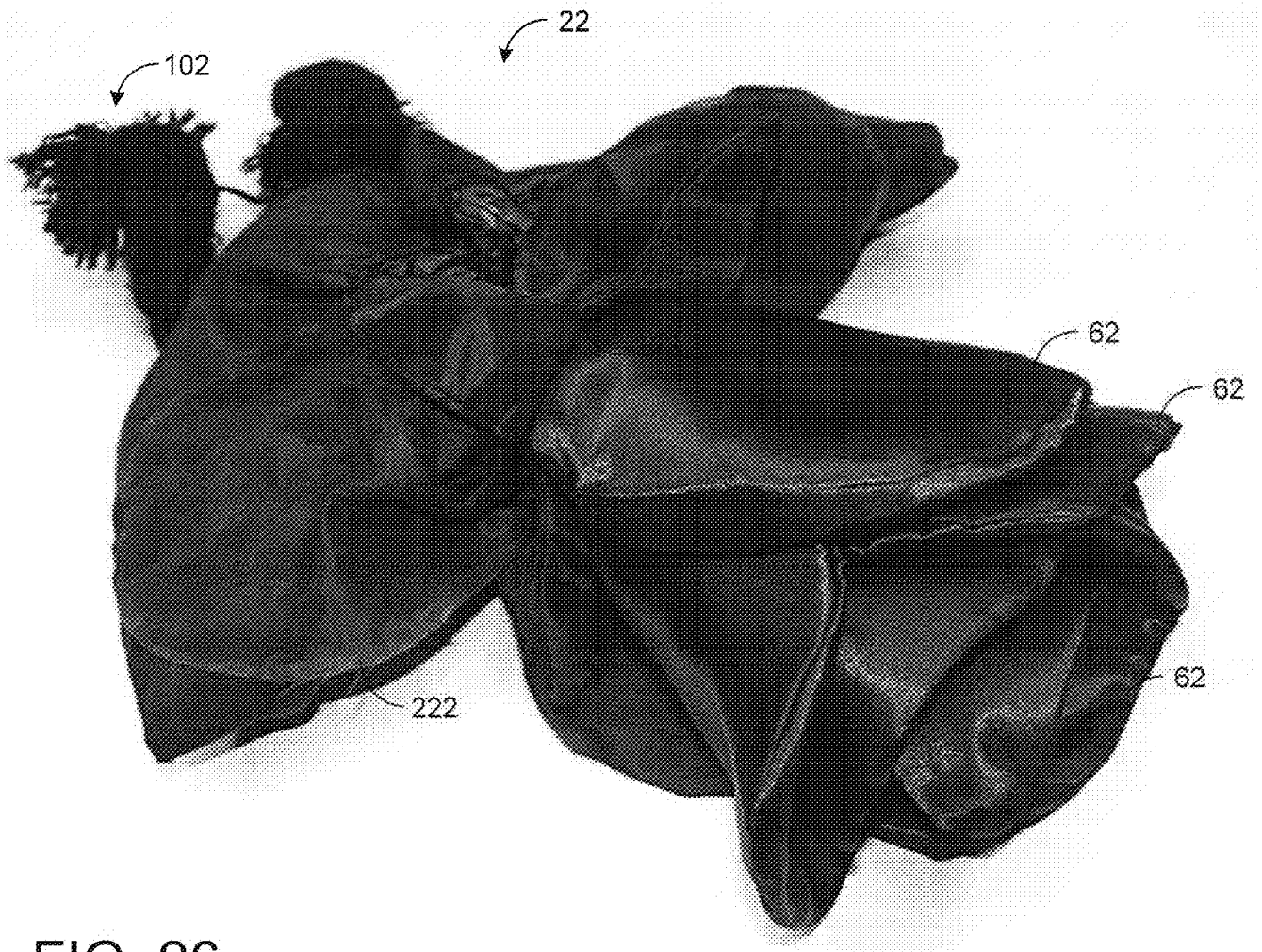
FIG. 26 depicts an exemplary embodiment of the toy depicted by FIG. 8.

It should be noted that any of the toys 21-24 may have attachment assemblies for controlling the girth of at least one component regardless of whether any of the covers 91-94 have slits. For example, FIG. 26 depicts an exemplary embodiment of the toy 22 for which an attachment assembly 501 is sewn or otherwise coupled to the cover 92. The attachment assembly 501 comprises a pair of Velcro strips 505 and 506. In other embodiments, the attachment assembly 501 may have other numbers of Velcro strips and/or other types of devices. To reduce the girth of the toy portion covered by the cover 92, the strips 505 and 506 are detachably coupled to each other. Accordingly, the doll 102 and/or other components of the toy 22 may be better hidden by the cover 92 as the toy 22 is used. Further, reducing a girth of the toy 22 via the attachment assembly 501 may facilitate placement of the toy 22 into a flower pot 42 or other container, particularly if the size of the pot 42 or other container is relatively small.

The specific dolls 21-24 are presented herein for illustrative purpose to facilitate a better understanding of the present disclosure. It should be apparent to one of ordinary skill in the art upon reading this disclosure that various modifications to the exemplary embodiments described above are possible and that various types of dolls and artificial flowers may be employed without departing from the spirit and scope of the present disclosure.

Now, therefore, the following is claimed:

1. A method for use with a topsy turvy toy for transforming the topsy turvy toy between an artificial flower and a doll, comprising the steps of:

positioning a body of the topsy turvy toy into a flower pot, the body having a first end and a second end that is opposite of the first end, wherein the first end forms the doll and the second end forms the artificial flower, wherein the doll has at least one head and at least one arm, and wherein the positioning step is performed such that the doll is inserted into the flower pot while the artificial flower is visible;

covering the doll with a cover of the topsy turvy toy while the body is positioned in the flower pot;

removing the topsy turvy toy from the flower pot; and moving the cover such that the doll is exposed and the artificial flower is hidden by the cover while the topsy turvy toy is removed from the flower pot.

2. The method of claim 1, wherein the cover forms at least a part of a dress for the doll.

3. The method of claim 1, wherein the cover has a slit.

4. The method of claim 3, further comprising the step of detachably coupling a first end of the cover to a second end of the cover via an attachment assembly on the cover.

5. The method of claim 1, wherein the artificial flower has a plurality of petals extending from the body.

6. The method of claim 1, wherein the first end forms a head of the doll, wherein the head is opposite of the artificial flower, and wherein the cover is coupled to the body between the head and the artificial flower.

7. The method of claim 1, wherein the artificial flower has a plurality of petals extending from an area of the body between the first and second ends.

8. The method of claim 4, wherein the attachment assembly includes a hook and loop arrangement.

9. The method of claim 4, wherein the attachment assembly includes a first component at the first end and a second component at the second end, and wherein the detachably coupling comprises detachably coupling the first component to the second component.

10. A method for use with a topsy turvy toy for transforming the topsy turvy toy between an artificial flower and a doll, comprising the steps of:

providing the topsy turvy toy, wherein a body of the topsy turvy toy has a first end and a second end that is opposite of the first end, wherein the first end forms the doll and the second end forms the artificial flower, and wherein the doll has at least one head and at least one arm;

covering the doll with a cover of the topsy turvy toy such that the doll is hidden and the artificial flower is visible; and moving the cover such that the doll is exposed and the artificial flower is hidden by the cover.

11. The method of claim 10, wherein the cover forms at least a part of a dress for the doll.

12. The method of claim 10, wherein the cover has a slit.

13. The method of claim 12, further comprising the step of detachably coupling a first end of the cover to a second end of the cover via an attachment assembly on the cover.

14. The method of claim 13, wherein the attachment assembly includes a hook and loop arrangement.

15. The method of claim 13, wherein the attachment assembly includes a first component at the first end and a second component at the second end, and wherein the detachably coupling comprises detachably coupling the first component to the second component.

16. The method of claim 10, wherein the artificial flower has a plurality of petals extending from the body.

17. The method of claim 10, wherein the first end forms a head of the doll, wherein the head is opposite of the artificial flower, and wherein the cover is coupled to the body between the head and the artificial flower.

18. The method of claim 10, wherein the artificial flower has a plurality of petals extending from an area of the body between the first and second ends.

* * * * *